US012383951B2

(12) United States Patent
Hattori

(10) Patent No.: US 12,383,951 B2
(45) Date of Patent: Aug. 12, 2025

(54) UPPER DIE AND MACHINING SYSTEM

(71) Applicant: MURATA MACHINERY, LTD., Kyoto (JP)

(72) Inventor: Katsumasa Hattori, Inuyama (JP)

(73) Assignee: MURATA MACHINERY, LTD., Kyoto (JP)

( * ) Notice: Subject to any disclaimer, the term of this patent is extended or adjusted under 35 U.S.C. 154(b) by 334 days.

(21) Appl. No.: 18/023,417

(22) PCT Filed: Aug. 6, 2021

(86) PCT No.: PCT/JP2021/029359
§ 371 (c)(1),
(2) Date: Feb. 27, 2023

(87) PCT Pub. No.: WO2022/059382
PCT Pub. Date: Mar. 24, 2022

(65) Prior Publication Data

US 2024/0024942 A1 Jan. 25, 2024

(30) Foreign Application Priority Data

Sep. 17, 2020 (JP) ..... 2020-156197

(51) Int. Cl.
*B21D 37/04* (2006.01)
*B21D 5/02* (2006.01)

(52) U.S. Cl.
CPC ..... *B21D 37/04* (2013.01); *B21D 5/0209* (2013.01)

(58) Field of Classification Search
CPC ..... B21D 37/04; B21D 5/0209; B21D 5/0254
See application file for complete search history.

(56) References Cited

U.S. PATENT DOCUMENTS 7,168,286 B1 1/2007 Pelech
8,752,410 B2 * 6/2014 Rogers ..... B21D 5/0236 72/413
10,144,049 B2 * 12/2018 Jansen ..... B21D 5/0227
2022/0203429 A1 * 6/2022 Sato ..... B21D 5/02

FOREIGN PATENT DOCUMENTS

JP 2019-181484 A 10/2019

OTHER PUBLICATIONS

Official Communication issued in International Patent Application No. PCT/JP2021/029359, mailed on Oct. 26, 2021.

* cited by examiner

*Primary Examiner* — Mohammed S. Alawadi
(74) *Attorney, Agent, or Firm* — Keating & Bennett, LLP

(57) ABSTRACT

An upper die is movable through a die guide rail on a lower portion of a ram in a press machine and a connection rail connected to the die guide rail. The upper die includes, on right and left sides of a center portion as viewed in a front-rear direction, protrusions that protrude in the front-rear direction and move while being guided by grooves included in the die guide rail and the connection rail. The protrusions each include an outer guided portion on an outer side in a transportation direction relative to the center portion and an inner guided portion on an inner side closer to the center portion than the outer guided portion, and a distance in the transportation direction between the outer guided portion and the inner guided portion is greater than a clearance distance between the die guide rail and the connection rail.

9 Claims, 17 Drawing Sheets

UPPER DIE AND MACHINING SYSTEM

BACKGROUND OF THE INVENTION

1. Field of the Invention

The present invention relates to an upper die and a machining system.

2. Description of the Related Art

A press machine clamps a workpiece between dies, i.e., an upper die and a lower die, and performs press machining, such as mold machining, on the workpiece. As one of the press machines, a press brake (bending machine) that performs bending on a plate-shaped workpiece is known. In a press brake, in order to perform desired bending on a workpiece, the arrangement or type of one or both of an upper die and a lower die may be changed. When attaching or changing the upper die, the upper die is transported through a die guide rail provided on a lower portion of a ram provided in the press machine and a connection rail connected to the die guide rail (for example, see Japanese Unexamined Patent Application, First Publication No. 2019-181484).

SUMMARY OF THE INVENTION

The upper die mentioned above has pins (protrusions) that protrude in a front-rear direction perpendicular to a transportation direction and an up-down direction and move while being guided by grooves provided in the die guide rail and the connection rail. On the upper die as viewed in the front-rear direction, the pins may be provided at two positions on both right and left sides of a center portion thereof, or at three positions, that is, at the center portion and at positions on both right and left sides of the center portion. In such a case, when the upper die is transported, the upper die rotates around the centroid position, and the pin on the forward side in the transportation direction may potentially fall into a clearance from the die guide rail or the connection rail and collide with an end portion of the groove. Such a collision between the pin and the groove not only causes abnormal noise (collision noise) when transporting the upper die but also results in unwanted damage to the pin (upper die) or the groove (the die guide rail or the connection rail).

Preferred embodiments of the present invention provide upper dies and machining systems each capable of stabilizing an attitude of an upper die when moving between a die guide rail and a connection rail to prevent a collision between a protrusion and a groove.

An upper die according to an aspect of a preferred embodiment of the present invention is an upper die that is movable through a die guide rail on a lower portion of a ram in a press machine and a connection rail connected to the die guide rail, the upper die including, on right and left sides of a center portion as viewed in a front-rear direction orthogonal to a transportation direction and an up-down direction, protrusions that protrude in the front-rear direction and are movable while being guided by grooves included in the die guide rail and the connection rail, wherein the protrusions each include an outer guided portion on an outer side in the transportation direction relative to the center portion and an inner guided portion on an inner side closer to the center portion as compared to the outer guided portion, and a distance in the transportation direction between the outer guided portion and the inner guided portion is greater than a distance length between the die guide rail and the connection rail.

A machining system according to an aspect of a preferred embodiment of the present invention is a machining system including a press machine to perform press machining on a workpiece via an upper die and a lower die, and a connection rail that is connected to a die guide rail on a lower portion of a ram in the press machine, the upper die being transported through the die guide rail and the connection rail, wherein the upper die is the upper die according to the aspect of a preferred embodiment of the present invention mentioned above.

According to the upper die and the machining system mentioned above, the distance in the transportation direction between the outer guided portion and the inner guided portion provided on the upper die is greater than the clearance distance between the die guide rail and the connection rail, and therefore, when the upper die is transported between the die guide rail and the connection rail, even when either one of the outer guided portion and the inner guided portion is positioned in the clearance between the die guide rail and the connection rail, the other remains in the state of being supported by the groove of the die guide rail or the connection rail. As a result, the outer guided portion or the inner guided portion is prevented from falling into the clearance. Therefore, the attitude of the upper die can be stabilized during transportation of the upper die and collision of the outer guided portion or the inner guided portion with the groove is avoided, thus preventing generation of abnormal noise and damage to the upper die, the die guide rail, and the connection rail.

The protrusions may include an outer pin defining the outer guided portion and an inner pin defining the inner guided portion. In such a configuration, the protrusions can be easily provided on the upper die. The outer pin may be above the inner pin. In such a configuration, collision of the outer pin with the groove can be reliably avoided. The outer pin and the inner pin may extend through through-holes in the front-rear direction and protrude from both a front side and a rear side, and an elastic body may be provided at least either between the outer pin and the through hole or between the inner pin and the through hole. In such a configuration, impact on one or both of the outer pin and the inner pin can be absorbed by the elastic body.

An auxiliary pin that protrudes in the front-rear direction and is movable while being guided by the groove may be provided between the inner pin on the left and the inner pin on the right. In such a configuration, the load of the upper die can be distributed by the outer pin, the inner pin, and the auxiliary pin. The protrusion may be a continuous protrusion protruding in a continuous manner from the outer guided portion to the inner guided portion. In such a configuration, the length of the continuous protrusion in the transportation direction is greater than the clearance distance, and it is thus possible to reliably prevent the outer guided portion or the inner guided portion from falling into the clearance. The continuous protrusion may include a tapered surface that slopes upward on a lower surface of at least either the outer guided portion or the inner guided portion. In such a configuration, collision of the continuous protrusion with the groove can be reliably avoided. The inner guided portion on the left and the inner guided portion on the right may protrude in a continuous manner. In such a configuration, the inner guided portion that continuously protruding can reliably bear the load of the upper die.

The upper die may include a locked portion extending in the front-rear direction, and the machining system may include a transporter that includes a locking portion extendible and retractable in the front-rear direction to lock the locked portion in the transportation direction, and to transport the upper die as the locking portion moves in the transportation direction while locking the locked portion. In such a configuration, the upper die can be easily transported by the transporter.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
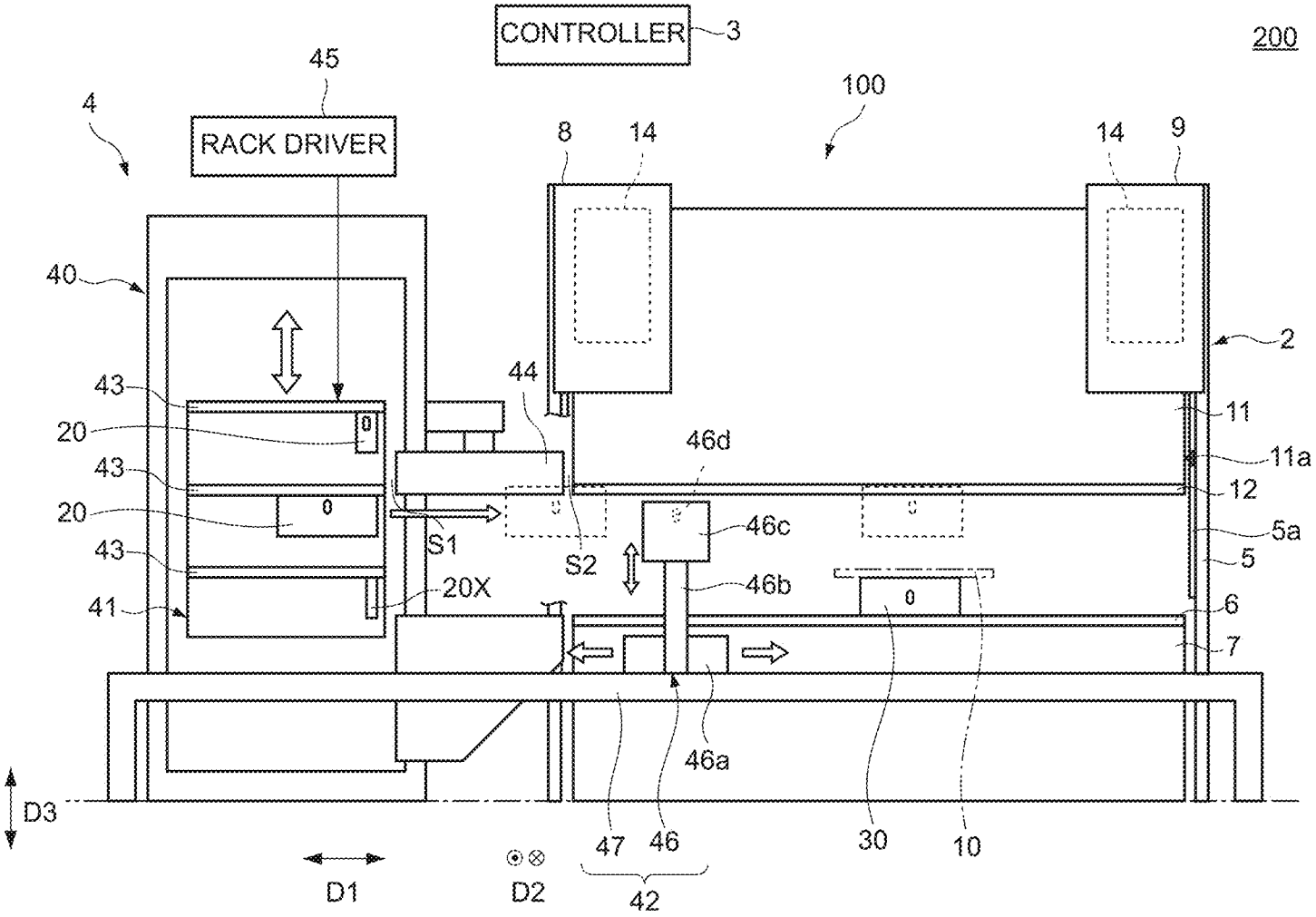
FIG. 1 is a front elevation view showing an example of an upper die and a machining system according to a first preferred embodiment of the present invention.

The following describes preferred embodiments of the present invention and modifications thereof, with reference to the drawings. However, the present invention is not limited to the following description. In the drawings, scale is changed as necessary to illustrate the preferred embodiments and modifications thereof, such as by enlarging or emphasizing a portion, and the shapes and dimensions in the drawings may differ from those of the actual product. In the following drawings, the directions in each drawing are described, using a Cartesian coordinate system represented by a transportation direction D1, a front-rear direction D2, and an up-down direction D3. In the Cartesian coordinate system, the transportation direction D1 and the front-rear direction D2 are parallel to the horizontal plane. Also, the transportation direction D1 may be referred to as left-right direction in some cases.

FIG. 1 is a front elevation view showing an example of an upper die 20 and a machining system 200 according to a first preferred embodiment. As shown in FIG. 1, the machining system 200 includes a press machine 100, a connection rail 44, and a die switching device 4. The press machine 100 is a press brake (bending machine) capable of performing bending (mold machining) on a workpiece 10. In the present preferred embodiment, a press brake will be described as an example of the press machine 100. The press machine 100 is not limited to being a press brake and may be a press machine capable of performing press-cutting (punching machining) or mold machining on a workpiece 10.

The press machine 100 includes a machining tool main body 2 and a controller 3. A front side of the machining tool main body 2 in the front-rear direction D2 is a work space for an operator. The operator places a workpiece 10 at a predetermined position from the front side of the machining tool main body 2 and can perform bending on the workpiece 10 by clamping the workpiece 10 between an upper die 20 and a lower die 30 defining and functioning as dies described later. The machining tool main body 2 includes a main body frame 5, a table 7, side covers 8, 9, a ram 11, and driving devices 14.

The main body frame 5 defines an outer framework of the press machine 100, for example. The table 7 is attached to the front side (front-facing side) of the main body frame 5 and fixes the lower die guide rail 6. The lower die guide rail 6 is provided on an upper surface of the table 7 and is structured to guide the lower die 30 along the transportation direction D1 (left-right direction). The lower die 30, on the upper surface side thereof, includes a V-shaped recess (not shown in the drawings) to bend the workpiece 10, for example. The recess is elongated along the transportation direction D1 (left-right direction). FIG. 1 shows an example in which the lower die 30 is moving while being guided by the lower die guide rail 6, however, the present invention is not limited to this example. For example, the present invention may also be embodied in a structure in which the lower die 30 extending in the transportation direction D1 is fixed on the upper surface of the table 7. The main body frame 5 or the table 7 may include a positioner (not shown in the drawings) against which the workpiece 10 abuts in the front-rear direction D2 to be positioned.

The side covers 8, 9 are provided respectively above both sides in the left-right direction of the main body frame 5. The side covers 8, 9 are positioned to respectively cover above both sides in the left-right direction of the ram 11. The main body frame 5 includes a plate-shaped guide 5*a* that extends in the up-down direction to guide the ram 11 in the up-down direction. The pair of left and right driving devices 14 are supported by the main body frame 5. The pair of driving devices 14 cause the ram 11 to move (ascend and descend) in the Z direction. To the driving devices 14 there is applied, for example, a mechanism that raises and lowers the ram 11 by rotating a ball screw or a nut with an electric motor or the like, or a mechanism that raises and lowers the ram 11 using a hydraulic cylinder device or a pneumatic cylinder device. The driving devices 14 are controlled by the controller 3.

The ram 11 is supported on the main body frame 5 by the guide 5*a* of the main body frame 5 so as to be able to ascend and descend. A pair of rollers 11*a* are provided at both left and right ends of the ram 11, and the pair of rollers 11*a* are arranged with the guide 5*a* provided on the main body frame 5 interposed therebetween. The ram 11 is guided in the up-down direction D3 by the pair of rollers 11*a* rolling along the guide 5*a*. The ram 11 is, for example, a plate made of a metal or the like and has a weight of several tens of kg to several hundreds of kg, for example. The ram 11 is connected to a portion of the driving devices 14 and is suspended by the driving devices 14. The ram 11 is raised or lowered by driving the driving devices 14 and approaches or moves away from the lower die 30 on the table 7.

On a lower portion of the ram 11 there is attached an upper die guide rail 12. The upper die guide rail 12 is a die guide rail that guides the upper die 20, which is a die. The upper die guide rail 12 is provided along the transportation direction D1 (left-right direction). The upper die guide rail 12 can support the upper die 20 while suspending it therefrom. The upper die guide rail 12 can guide the upper die 20 being transported in the transportation direction D1. It should be noted that the upper die guide rail 12 may guide the upper die 20 in the transportation direction D1 without supporting it. In the present specification, when transporting the upper die 20 in a predetermined direction (for example, in the transportation direction D1), "guiding" means directing the upper die 20 so as not to deviate from the predetermined direction. The ram 11 includes a clamp member 15 (see FIG. 3) to hold the upper die 20 guided by the upper die guide rail 12. The clamp member 15 is inserted into a hole 12*c* (see FIG. 3) in the front-rear direction D2 provided in the upper die guide rail 12 and is caused to advance and retreat in the front-rear direction D2 by the clamp driver 16 (see FIG. 3). The holes 12*c* are provided at a plurality of locations on the upper die guide rail 12 in the transportation direction D1, and the clamp member 15 is arranged in each hole 12*c*. When performing bending on the workpiece 10, the upper die 20 according to each step of a bending process is arranged on the upper die guide rail 12. The clamp driver 16 causes the clamp member 15 to advance, and a distal end of the clamp member 15 lifts and presses a clamp recess 27 of the upper die 20 (see FIG. 3) to fix the upper die 20 at a predetermined position. As the clamp member 15 advances, the upper die 20 is clamped against and held between the distal end of the clamp member 15, one side surface of a recess 12*b* of the upper die guide rail 12 facing the distal end of the clamp member 15, and an upper surface of the recess 12*b*. The details of the upper die 20 and the state of the upper die 20 when being clamped will be described later.

The upper die 20 is fixed to the ram 11 by the clamp member 15 at a predetermined position on the upper die 12. When held on the upper die guide rail 12, the upper die 20 is arranged so that a cutting edge 22 (see FIG. 3), which is a lower end thereof (see FIG. 3), faces a recess (not shown in the drawings) of the lower die 30 and, at the same time, the cutting edge 22 is arranged along the transportation direction D1 (left-right direction). The upper die 20 fixed to ram 11 ascends or descends together with the ram 11. The plurality of upper dies 20 held on the upper die guide rail 12 may have the same dimension in the transportation direction D1 (left-right direction), or the upper dies 20 having different dimensions in the left-right direction may be combined for use. In the press machine 100, the upper die 20 descends toward the lower die 30 as the ram 11 descends and the workpiece 10 is clamped between the upper die 20 and the lower die 30. Bending is then performed on the workpiece 10 until the upper die 20 has reached, for example, a lowest point. The angle of bending to be performed on the workpiece 10 can be changed by the amount of descent of the upper die 20.

The die switching device 4 switches the upper die 20 on the machining tool main body 2 of the press machine 100. The die switching device 4 can also switch the lower die 30 on the machining tool main body 2. Hereinafter, in the present preferred embodiment, a case of switching the upper die 20 will be described as an example. The die switching device 4 includes a stocker 40 and a transporting device 42. The stocker 40 includes one or more racks 41 and a rack driver 45. When the stocker 40 includes a plurality of racks 41, the plurality of racks 41 are accommodated in a state of being aligned along the front-rear direction D2. The rack 41 is a plate-shaped body that can be stored in the stocker 40 and has one or more cassettes 43. When one rack 41 includes a plurality of cassettes 43, the plurality of cassettes 43 are aligned along the up-down direction D3.

Each cassette 43 includes a rail extending in the transportation direction D1. The cassette 43 can support the upper die 20 while suspending it therefrom. The cassette 43 can guide the upper die 20 being transported in the transportation direction D1. It should be noted that the cassette 43 may guide the upper die 20 in the transportation direction D1 without supporting it. The shape of a portion of the cassette 43 from which the upper die 20 is suspended is substantially the same as that of the upper die guide rail 12 mentioned above. In one rack 41, the plurality of cassettes 43 are aligned along the up-down direction D3. The number of cassettes 43 provided in one rack 41 is determined by the size of the rack 41, the dimensions of the upper die 20 to be suspended, and so forth. One cassette 43 can support one or more upper dies 20 while suspending them therefrom.

Each cassette 43 may store a spacer (not shown in the drawings) in a state of being suspended, in addition to the upper die 20. Each of these spacers is arranged between the upper dies 20 on the upper die guide rail 12 and is used to regulate the interval between the upper dies 20 in the transportation direction D1 (left-right direction). Each spacer may be individually transported by the transporting device 42 as with the upper dies 20, or, when transporting the upper die 20, may be arranged on the front side of the upper die 20 in the transportation direction and transported together with the upper die 20. Whether or not to use the spacers is optional.

The rack driver 45 raises or lowers the rack 41 and aligns the height of one of the cassettes 43 with the height of the connection rail 44. The rack driver 45 can also change the arrangement order of the plurality of racks 41 in the front-rear direction D2 so as to bring one of the plurality of racks 41 to the frontmost side. For example, the rack driver 45 can switch the racks 41 by lifting the rack 41 on the frontmost side, moving it to an empty space on the far side in the stocker 40, and then lifting another rack 41 and moving it to the frontmost side.

The transporting device 42 transports the upper die 20 between the machining tool main body 2 and the rack 41. The transporting device 42 transports the upper die 20 of the cassette 43 set at the height of the connection rail 44 by the rack driver 45 to the upper die guide rail 12 of the machining tool main body 2 via the connection rail 44, or transports the upper die 20 on the upper die guide rail 12 to the cassette 43 via the connection rail 44. The transporting device 42 includes a transporter 46 and a transportation guide 47.

The transporter 46 includes a slider 46*a*, an elevation rod 46*b*, a head 46*c*, and a locking portion 46*d*. The slider 46*a* can be reciprocated by a driver not shown in the drawings in the transportation direction D1 (left-right direction) along the transportation guide 47. The elevation rod 46*b* is provided on the slider 46*a* so as to be able to be raised or lowered and can be raised and lowered along the up-down direction D3 by a driver not shown in the drawings. The head 46*c* is provided at an upper end of the elevation rod 46*b* and is raised or lowered along the up-down direction as the elevation rod 46*b* is raised or lowered. The head 46*c* causes the locking portion 46*d* to advance or retreat in the front-rear direction D2. The locking portion 46*d* is, for example, of a bar shape having a cross-sectionally oval, elliptical or circular shape, or having a cross-sectionally polygonal shape such as a rectangular shape, and extending in the front-rear direction D2, and can be inserted into a locked portion 28 (see FIG. 3) of the upper die 20 described later.

The transportation guide 47 guides the transporter 46 in the transportation direction D1 (left-right direction). The transportation guide 47 is provided, for example, on a floor surface on which the machining system 200 is installed and is provided in a linear manner along the transportation direction D1 (left-right direction). The transportation guide 47 is parallel to the upper die guide rail 12, the connection rail 44, and the cassette 43. The transporter 46 can arrange the head 46*c* (that is, the locking portion 46*d*) at any position in the transportation direction D1 and the up-down direction D3, via the transportation guide 47 and the elevation rod 46*b* within each movable range thereof.

Figure 2:
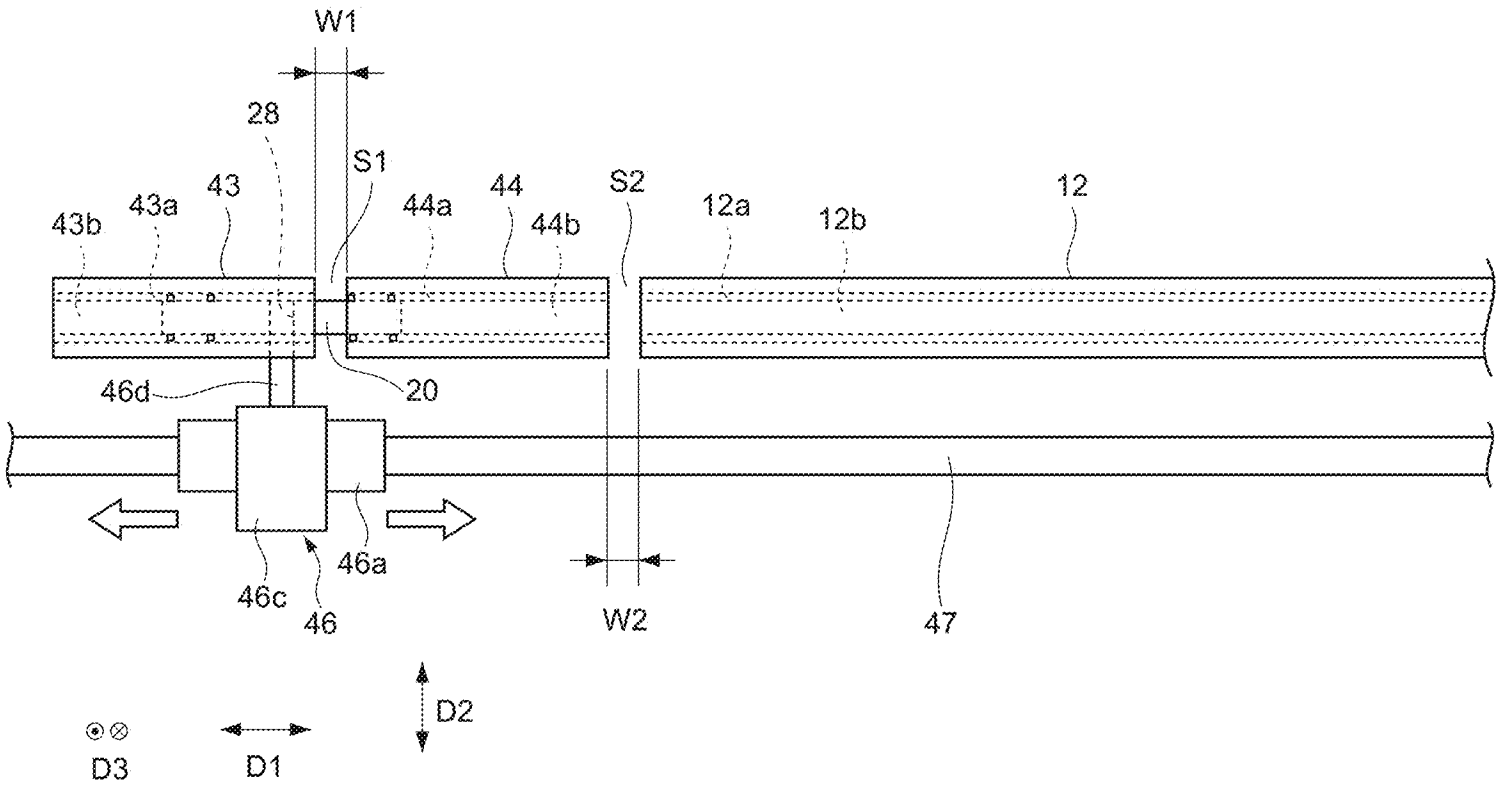
FIG. 2 is a plan view showing an example of an upper die guide rail and a connection rail.

The transporter 46 causes the locking portion 46*d* to advance in the front-rear direction D2 to be inserted into the locked portion 28 of the upper die 20, and, in this state, causes the slider 46*a* to move, to thereby be able to transport the upper die 20 in the transportation direction D1 (See FIG. 2). The transporting device 42 configured in such a manner is controlled by the controller 3. In the present preferred embodiment, a structure in which a plurality of upper dies 20 are accommodated in the stocker 40 has been described as an example. However, the lower die 30 may be supported by the cassette 43 of the rack 41 and a plurality of the lower dies 30 may also be accommodated together in the stocker 40.

The connection rail 44 connects between the cassette 43 of the rack 41 and the upper die guide rail 12 of the machining tool main body 2. The connection rail 44 is attached to the stocker 40 by a support member or the like, for example. The connection rail 44 is provided so as to extend along the transportation direction D1, and the height position thereof in the up-down direction D3 is fixed. Therefore, as the rack 41 is raised or lowered, the connection rail 44 is aligned with one of the cassettes 43 of the rack 41 along the transportation direction D1, and also at a predetermined height position (for example, top dead point position or highest position) of the ram 11, it is aligned with the upper die guide rail 12 along the transportation direction D1. The height of the connection rail 44 is preliminarily set to a height of the upper die guide rail 12 that allows switching of the upper dies 20, and the rack driver 45 is driven so as to adjust and align the height of the cassette 43 to the height of the connection rail 44.

As with the upper die guide rail 12, the connection rail 44 can support the upper die 20 while suspending it therefrom. The connection rail 44 can guide the upper die 20 being transported in the transportation direction D1 (left-right direction). It should be noted that the connection rail 44 may guide the upper die 20 in the transportation direction D1 without supporting it. The shape of a portion of the connection rail 44 from which the upper die 20 is suspended is the same or substantially the same as those of the upper die guide rail 12 and the cassette 43. The connection rail 44 may be rotatable around an axis parallel to the up-down direction D3. By rotating the connection rail 44 by 180 degrees while supporting the upper die 20 thereon, the upper die 20 can be reversed in the front-rear direction D2. Whether or not to include such a reversing mechanism for the upper die 20 using the connection rails 44 is optional, and the connection rails 44 may not be rotatable.

FIG. 2 is a plan view showing an example of the upper die guide rail 12 and the connection rail 44. FIG. 2 also includes illustration of the cassette 43. As shown in FIG. 1 and FIG. 2, the connection rail 44 is arranged with a clearance S1 from the cassette 43 in the transportation direction D1. The connection rail 44 is arranged with a clearance S2 from the upper die guide rail 12 in the transportation direction D1. When transported from the cassette 43 to the upper die guide rail 12, the upper die 20 is transported in the transportation direction D1 over the clearance S1 and the clearance S2 in sequence. When transported from the upper die guide rail 12 to the cassette 43, the upper die 20 is transported in the transportation direction D1 over the clearance S2 and the clearance S1 in sequence.

Figure 3:
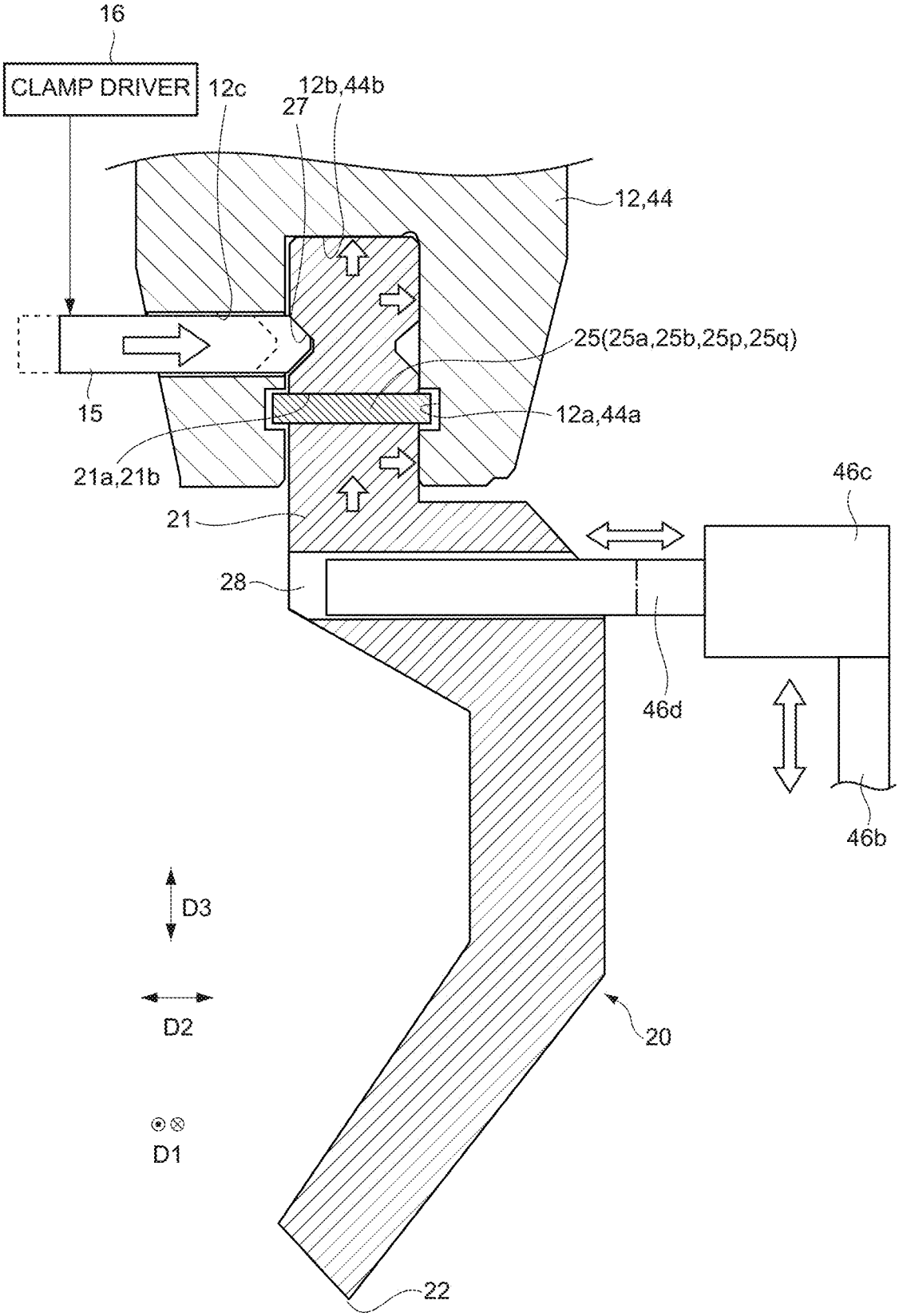
FIG. 3 is a cross-sectional view of the upper die and the connection rail (die guide rail) as viewed in the transportation direction.
Figure 4:
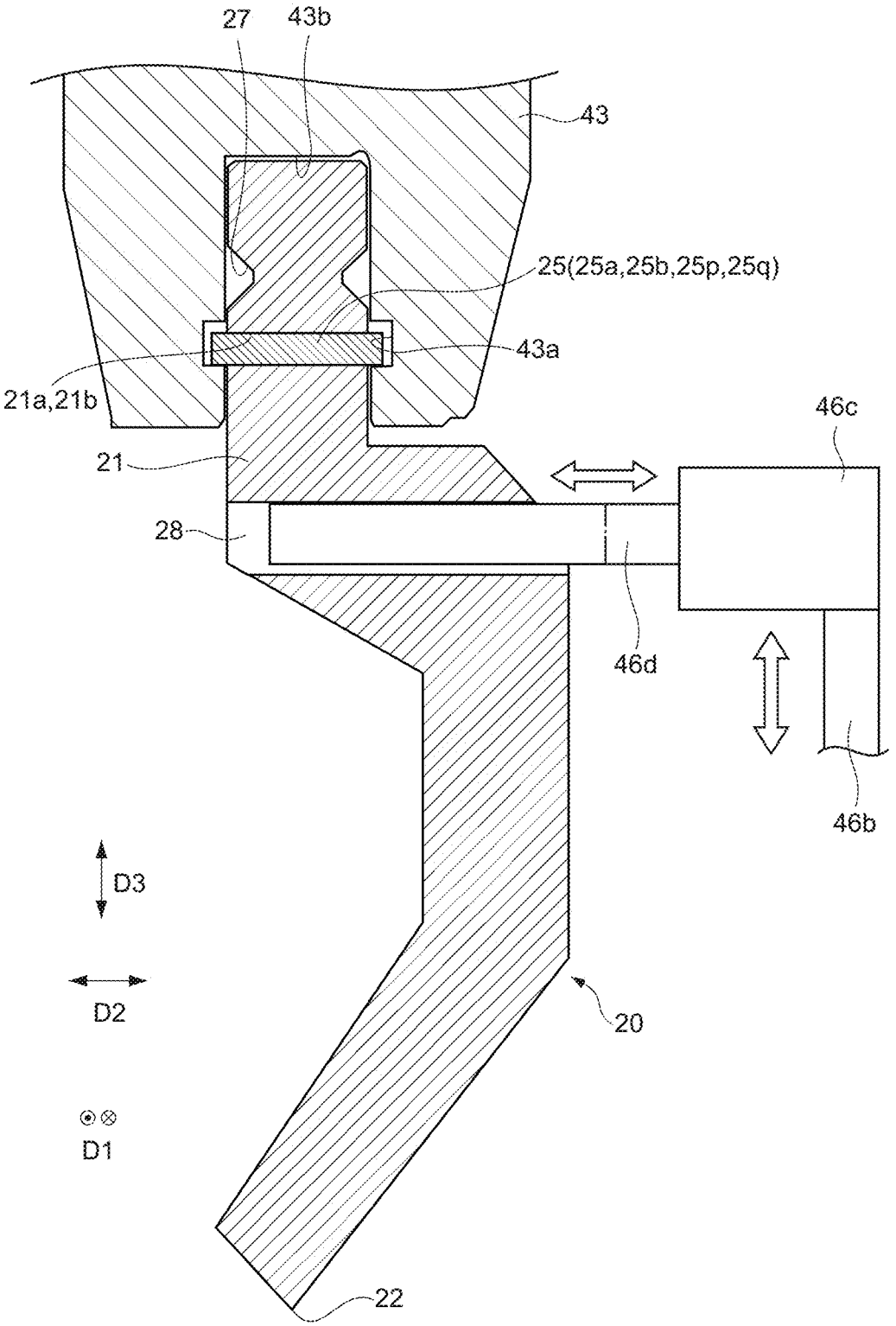
FIG. 4 is a cross-sectional view of the upper die and a cassette as viewed in the transportation direction.
Figure 5:
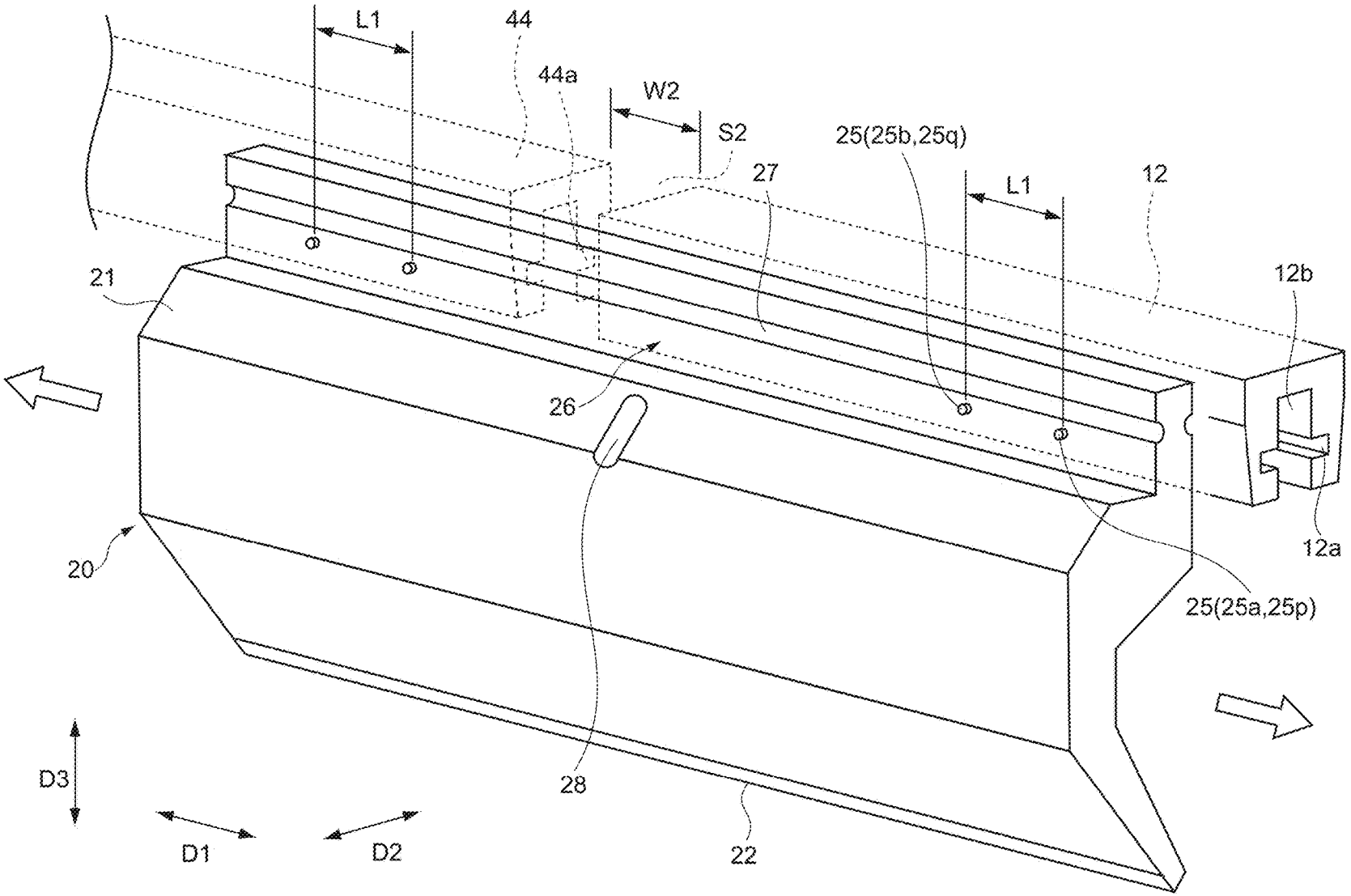
FIG. 5 is a perspective view showing an example of the upper die according to the first preferred embodiment of the present invention.
Figure 6:
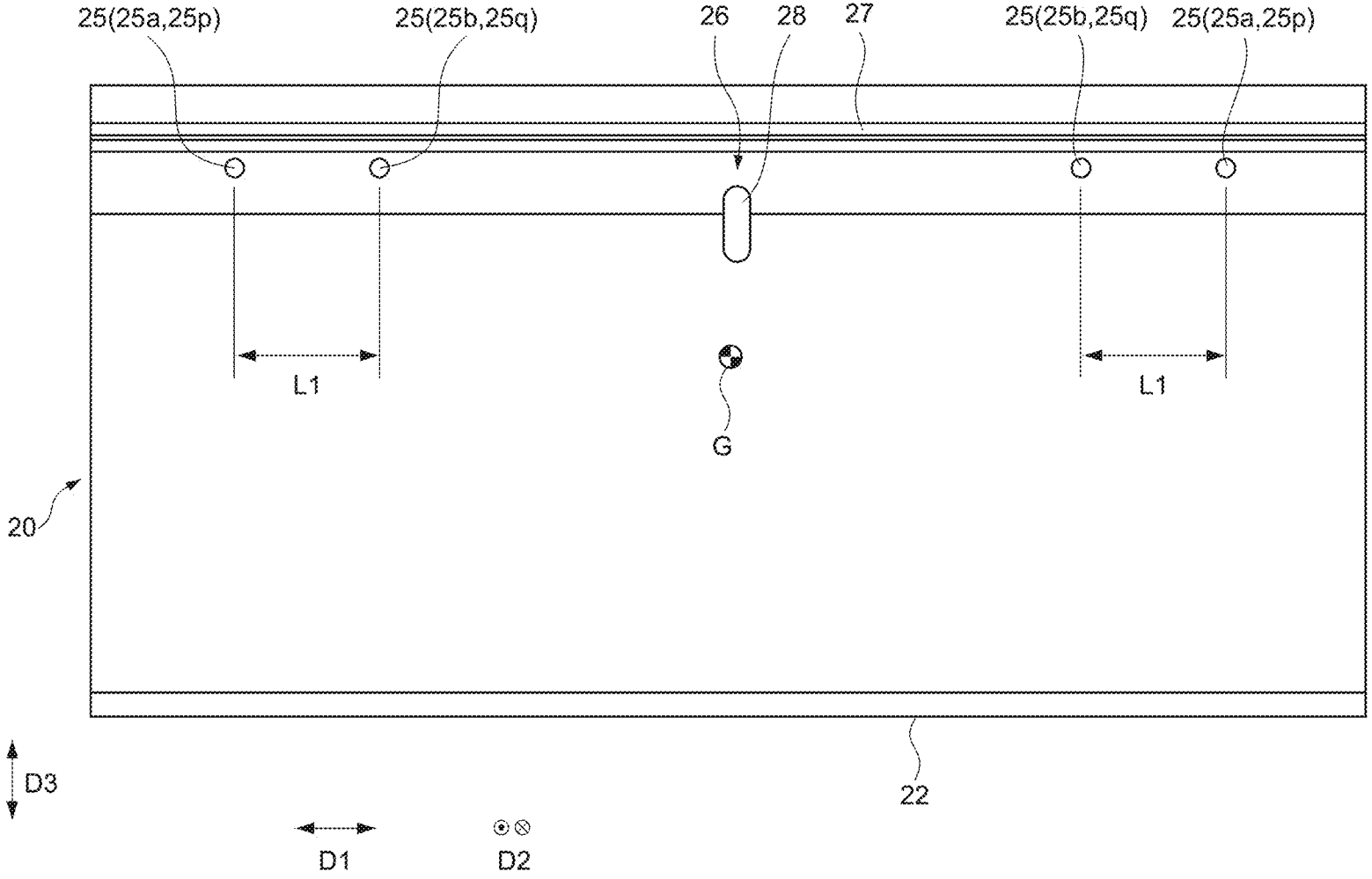
FIG. 6 is a front elevation view showing an example of the upper die.

FIG. 3 is a cross-sectional view of the upper die 20 and the connection rail 44 (die guide rail 12) as viewed in the transportation direction D1. FIG. 4 is a cross-sectional view of the upper die 20 and the cassette 43 as viewed in the transportation direction D1. FIG. 5 is a perspective view showing an example of the upper die 20 according to the first preferred embodiment. FIG. 6 is a front elevation view showing an example of the upper die 20. In FIG. 3 and FIG. 4, clearances are exaggerated and enlarged, and differ from the actual clearances. As shown in FIG. 3, in the upper die guide rail 12 and the connection rail 44 there are provided recesses 12*b*, 44*b* respectively, in each of which an upper portion of a base 21 of the upper die 20 enters and each of which extends in the transportation direction D1. In these recesses 12*b*, on 44*b*, on each of side surfaces opposing to each other in the front-rear direction D2, there are respectively provided grooves 12*a*, 44*a* extending in the transportation direction D1.

As shown in FIG. 3 to FIG. 6, the upper die 20 has the base 21 supported by the connection rail 44 and so forth, and the cutting edge 22, which is a distal end opposite to the base 21. The base 21 of the upper die 20 has protrusions 25 protruding in the front-rear direction D2. The protrusions 25 are arranged on each of both left and right sides of the center portion 26 as viewed in the front-rear direction D2. The protrusions 25 move while being guided by the groove 12*a* provided in the upper die guide rail 12 and the groove 44*a* provided in the connection rail 44. Although not shown in FIG. 5, the protrusions 25 move while being guided by a groove 43*a* provided in the cassette 43.

The protrusions 25 include outer guided portions 25*a* and inner guided portions 25*b*. The outer guided portions 25*a* are positioned on the outer side of the center portion 26 in the transportation direction D1. In the present preferred embodiment, the outer guided portions 25*a* are outer pins 25*p*. Each outer pin 25*p* is provided, for example, by inserting a rod-shaped body having a circular cross-section through a through hole 21*a* extending along the front-rear direction D2 in a portion of the base 21, allowing both ends of the rod-shaped body to protrude from both of the front side and the rear side of the base 21. The inner guided portions 25*b* are positioned on the inner side closer to the center portion 26 than the outer guided portions 25*a*. In the present preferred embodiment, the inner guided portions 25*a* are inner pins 25*q*. Each inner pin 25*q* is provided, for example, by inserting a rod-shaped body having a circular cross-section through a through hole 21*b* extending along the front-rear direction D2 in a part of the base 21, allowing both ends of the rod-shaped body to protrude from both of the front side and the rear side of the base 21.

The outer pins 25*p* and the inner pins 25*q* are not limited to being provided by inserting rod-shaped bodies through the through holes 21*a*, 21*b*. For example, the outer pins 25*p* and the inner pins 25*q* may be formed by cutting when forming the base 21, so that the outer pins 25*p* and the inner pins 25*q* are integrated with the base 21. The cross-sectional shape of the outer pin 25*p* and the inner pin 25*q* is not limited to a circular shape, and it may, for example, be an oval shape, an elliptical shape, or a polygonal shape such as a rectangular shape.

A distance L1 in the transportation direction D1 between the outer pin 25*p* and the inner pin 25*q* is greater than a clearance distance W2 in the transportation direction D1 of the clearance S2 between the upper die guide rail 12 and the connection rail 44. Therefore, when the upper die 20 moves over the clearance S2 between the connection rail 44 and the upper die guide rail 12, the outer pin 25*p* and the inner pin 25*q* do not fall into the clearance S2 at the same time. That is to say, even if either one of the outer pin 25*p* and the inner pin 25*q* is positioned within the clearance S2, the other is supported on the groove 12*a* or the groove 44*a*. As a result, the outer pin 25*p* or the inner pin 25*q* is prevented from falling into the clearance S2.

The distance L1 between the outer pin 25*p* and the inner pin 25*q* is greater than a clearance distance W1 (see FIG. 2) in the transportation direction D1 of the clearance S1 between the cassette 43 and the connection rail 44. Therefore, when the upper die 20 moves over the clearance S1 between the cassette 43 and the connection rail 44, the outer pin 25*p* and the inner pin 25*q* do not fall into the clearance S1 at the same time. That is to say, even if either one of the outer pin 25*p* and the inner pin 25*q* is positioned within the clearance S1, the other is supported on the groove 12*a* or the groove 44*a*. As a result, the outer pin 25*p* or the inner pin 25*q* is prevented from falling into the clearance S1.

The base 21 of the upper die 20 includes the clamp recesses 27 and a locked portion 28. Each clamp recess 27 extends along the transportation direction D1, on both the front-facing side (front side) and the rear-facing side of the base 21. The clamp recess 27 is a portion pressed by the clamp member 15 provided on the upper die guide rail 12. When the clamp member 15 is advanced by the clamp driver 16, the distal end of the clamp member 15 comes into contact with a tapered portion on the upper-face side of the clamp recess 27. The distal end of the clamp member 15 presses the clamp recess 27 in the front-rear direction D2 while lifting it. As a result, the base 21 of the upper die 20 is pressed against the upper surface and one side surface of the recess 12*b*. That is to say, the base 21 is held by being clamped between the clamp member 15, the upper surface, and the one side surface of the recess 12*b*, and the upper die 20 is clamped as a result. At this time, the outer pins 25*p* and the inner pins 25*q* are hovering over the lower surface of the groove 12*a*. Also, the locked portion 28 is hovering over the locking portion 46*d* of the transporter 46, and there is a clearance between the locked portion 28 and the upper surface side of the locking portion 46*d*. When the clamp member 15 retreats (unclamped), the base 21 (upper die 20) descends, and the outer pin 25*p* and the inner pin 25*q* return to the state of being placed (seated) on the lower surface of the groove 12*a*. This state is a state in which the upper die 20 is supported by the upper die guide rail 12, that is, a state in which the upper die 20 is being transported. It should be noted that the clamp member 15 mentioned above is also provided on the connection rail 44. For example, when reversing the upper die 20 supported on the connection rail 44, the clamp member 15 is advanced to support the upper die 20 on the connection rail 44.

As shown in FIG. 4, in the cassette 43 there is provided a recess 43*b* as a rail, in which the upper portion of the base 21 of the upper die 20 enters and which extends in the transportation direction D1. In this recess 43*b*, on each of side surfaces opposing to each other in the front-rear direction D2, there is provided a groove 43*a* extending in the transportation direction D1. The shapes of the recess 43*b* and the groove 43*a* are the same as those of the recesses 12*b*, 44*b* and the grooves 12*a*, 44*a* mentioned above. The outer pin 25*p* and the inner pin 25*q* of the upper die 20 are placed on the lower surface of the groove 43*a*, and, in this state, the upper die 20 is supported by and suspended from the cassette 43. At this time, there is a clearance between the base 21 and each of the upper surface and the side surfaces of the recess 43*b*. When the upper die 20 is being transported, the upper side clearance between the locked portion 28 and the locking portion 46*d* is eliminated or reduced.

The positional relationship between the recess 43*b* and the groove 43*a*, the base 21 of the upper die 20, and the outer pin 25*p* and the inner pin 25*q* as shown in FIG. 4 is similar to that in the state where the clamp member 15 has retreated on the upper die guide rail 12 or the connection rail 44 (unclamped state). That is to say, in the state where the upper die 20 is suspended from the upper die guide rail 12 or the connection rail 44, as with FIG. 4, the outer pin 25*p* and the inner pin 25*q* of the upper die 20 are placed on the lower surface of the grooves 12*a*, 44*a*, and there is a clearance between the base 21 and each of the upper surface and one side surface of the recesses 12*b*, 44*b*. When the upper die 20 is being transported on the upper die guide rail 12 or the connection rail 44, the upper side clearance between the locked portion 28 and the locking portion 46*d* is eliminated or reduced.

The locked portion 28 is provided in the vicinity of the center portion 26 of the base 21 so as to pass therethrough in the front-rear direction D2. In the present preferred embodiment, the structure in which the locked portion 28 is a hole is described as an example, however, the present invention is not limited to this form. The locked portion 28 is provided above the centroid G of the upper die 20. The locked portion 28 is sized to allow the locking portion 46*d* of the transporter 46 to be inserted thereinto. For example, in the case where the cross-sectional shape of the locking portion 46*d* is a vertically elongated oval shape, the locked portion 28 is also of a vertically elongated oval shape and passes therethrough. In the present preferred embodiment, the structure in which the locking portion 46*d* is a rod-shaped body is described as an example, however, the present invention is not limited to this form. To the locking portion 46*d* and the locked portion 28, it is possible to apply any configuration that can realize a locked state and a non-locked state (released state) between the two. The transporter 46 inserts the locking portion 46*d* into the locked portion 28, and, in this state, by moving the transporter 46 along the transportation guide 47, it is possible to move the upper die 20 along the transportation direction D1. As described above, a single pair of the locked portion 28, which is a hole, and the locking portion 46*d*, which is a rod-shaped body, is sufficient when transporting the upper die 20, and it is therefore possible to reduce the cost required for transporting the upper die 20. Since only one locked portion 28 (hole) is provided in the upper die 20, it is possible to suppress a reduction in the rigidity of the upper die 20.

In the state where the locking portion 46*d* is inserted in the locked portion 28, there is a slight clearance between the locking portion 46*d* and the locked portion 28. Therefore, even in the state where the oval-shaped locking portion 46*d* is inserted in the oval-shaped locked portion 28, the upper die 20 can still rotate slightly around the locking portion 46*d*. As a result, even when being transported in the transportation direction D1, the upper die 20 is transported in the transportation direction D1 while still being rotatable around the locking portion 46*d*. However, as mentioned above, even if either one of the outer pin 25*p* and the inner pin 25*q* reaches the clearances S1, S2, the other is supported on the groove 12*a* or the groove 44*a*. As a result, rotation of the upper die 20 around the locking portion 46*d* is regulated, and the outer pin 25*p* or the inner pin 25*q* is prevented from falling into the clearance S2.

In the present preferred embodiment, the upper die 20 is transported with one locking portion 46*d*. However, instead of using such a configuration, if a plurality of (for example, two) locked portions 28 are provided in the upper die 20, a plurality of (for example, two) locking portions 46*d* may be inserted respectively into the locked portions 28 to perform transportation in the transportation direction D1.

The upper die 20 is not limited to including the locked portion 28 passing therethrough to insert the locking portion 46*d*. For example, a type of an upper die having a short dimension in the transportation direction D1 such as an upper die 20X shown in FIG. 1 may not include the locked portion 28 that passes therethrough. In such a case, the transporter 46 may transport the upper die 20X by pushing an edge of the upper die 20X in the transportation direction D1 from the rear side, using the locking portion 46*d*. In the present preferred embodiment, the upper die 20 bending in the front-rear direction D2 from the base 21 toward the cutting edge 22 is used (see FIG. 3 and so forth). However, the present invention is not limited to this example, and an upper die 20 not bending from the base 21 toward the cutting edge 22 (straight upper die 20) may be used.

Returning to FIG. 1, the controller 3 controls operations of the machining tool main body 2 and the die switching device 4 in a comprehensive manner. The controller 3 may be connected to a host device not shown in the drawings. The host device supplies the controller 3, for example, with design data, such as CAD data or CAM data, for the workpiece 10.

Next, an example of a method for transporting the upper die 20 according to the present preferred embodiment will be described. The controller 3 selects the upper die 20 to be used for machining, on the basis of a machining program for a machining target workpiece 10, for example. The controller 3 drives the rack driver 45 so as to connect the cassette 43 supporting the selected upper die 20 to the connection rail 44. The rack driver 45 positions the rack 41 having the cassette 43 supporting the selected upper die 20 on the frontmost side and raises or lowers the rack 41 so that the cassette 43 supporting the selected upper die 20 is at the same height as the that of the connection rail 44.

Then, the controller 3 causes the head 46*c* of the transporter 46 to move in the transportation direction D1 and the up-down direction D3 so that the locking portion 46*d* faces the locked portion 28 of the selected upper die 20. Then, the controller 3 causes the locking portion 46*d* to advance to insert it into the locked portion 28. After having inserted the locking portion 46*d* into the locked portion 28, the head 46*c* (slider 46*a*) is moved in the transportation direction D1 to thereby transport the upper die 20 from the cassette 43 to the upper die guide rail 12 via the connection rail 44. When transporting the upper die 20, transportation may be performed with the locking portion 46*d* (head 46*c*) raised slightly. This operation reduces the load of the upper die 20 applied to the outer pin 25*p* and the inner pin so that it is possible to reduce friction between the outer pin 25*p* and the inner pin 25*q*, and the grooves 12*a*, 43*a*, 44*a*.

When both transferring the upper die 20 from the cassette 43 to the connection rail 44 and transferring the upper die 20 from the connection rail 44 to the upper die guide rail 12, the upper die 20 passes through the clearances S1, S2. The upper die 20 moves while being pushed by the locking portion 46*d* inserted in the locked portion 28, however, the position of the locked portion 28 is above the centroid G of the upper die 20. Therefore, a clockwise (as viewed in the drawings) moment is acting on the upper die 20 as being pushed by the locking portion 46*d*, and a downward force is acting on the outer pin 25*p* on the leading side. Therefore, when there is a clearance in the transportation path, this outer pin 25*p* is likely to fall into the clearance.

Figure 7A:
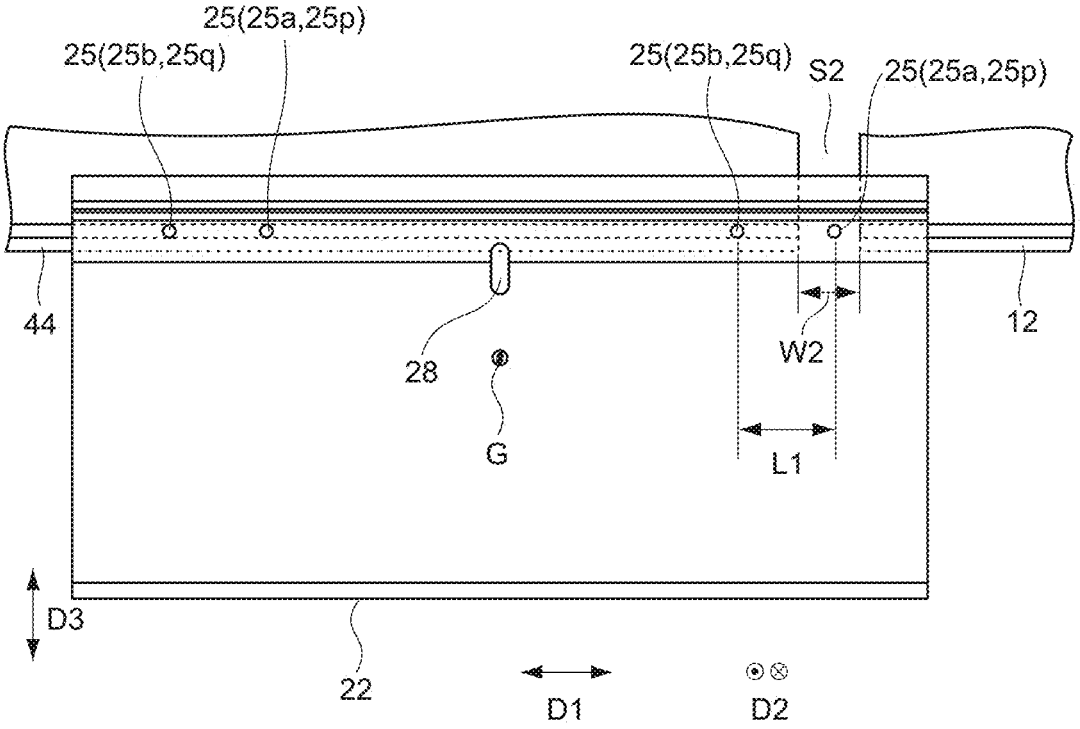
FIGS. 7A and 7B show states in which an outer pin (outer guided portion) is positioned in a clearance during transportation of the upper die, FIG. 7A being a front elevation view, and FIG. 7B being a plan view.
Figure 7B:
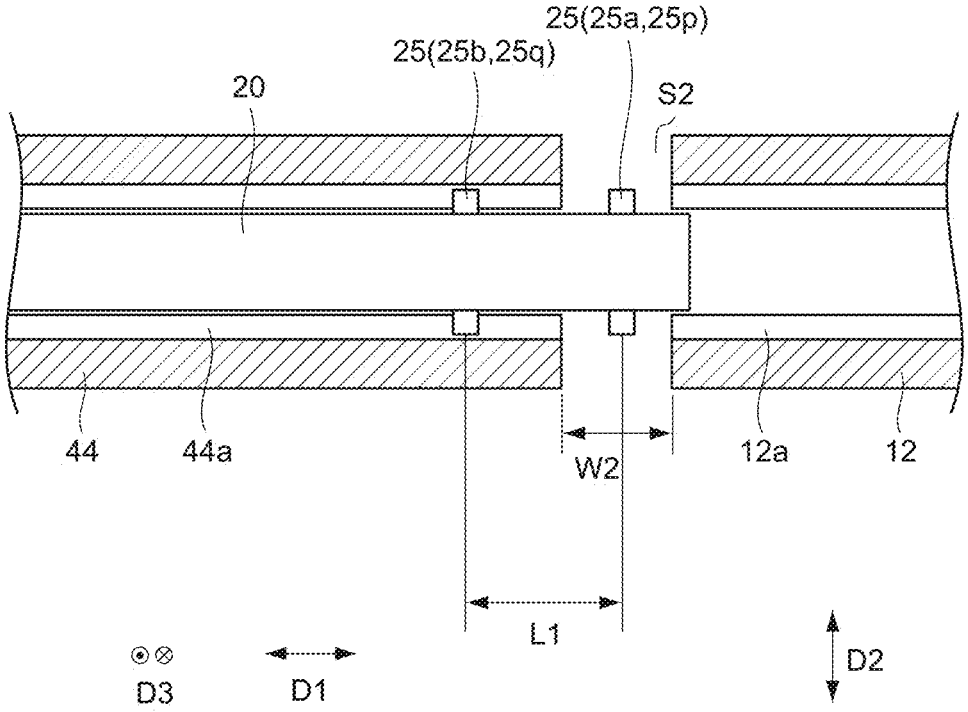

FIGS. 7A and 7B show states in which the outer pin 25*p* (outer guided portion 25*a*) is positioned in the clearance S2 during transportation of the upper die 20, FIG. 7A being a front elevation view, and FIG. 7B being a plan view. As shown in FIGS. 7A and 7B, when transporting the upper die 20 from the connection rail 44 to the upper die guide rail 12, first, the outer pin 25*p* on the leading side in the traveling direction is positioned in the clearance S2. At this time, since the distance L1 between the outer pin 25*p* and the inner pin 25*q* is greater than the clearance distance W2 of the clearance S2, even if the outer pin 25*p* is positioned in the clearance S2, the inner pin 25*q* remains in the state of being supported by the groove 44*a* of the connection rail 44. As a result, the outer pin 25*p* is prevented from falling into the clearance S2, and the attitude of the upper die 20 is stabilized. It is thus possible to prevent the outer pin 25*p* from colliding with the end portion of the groove 12*a*.

Figure 8A:
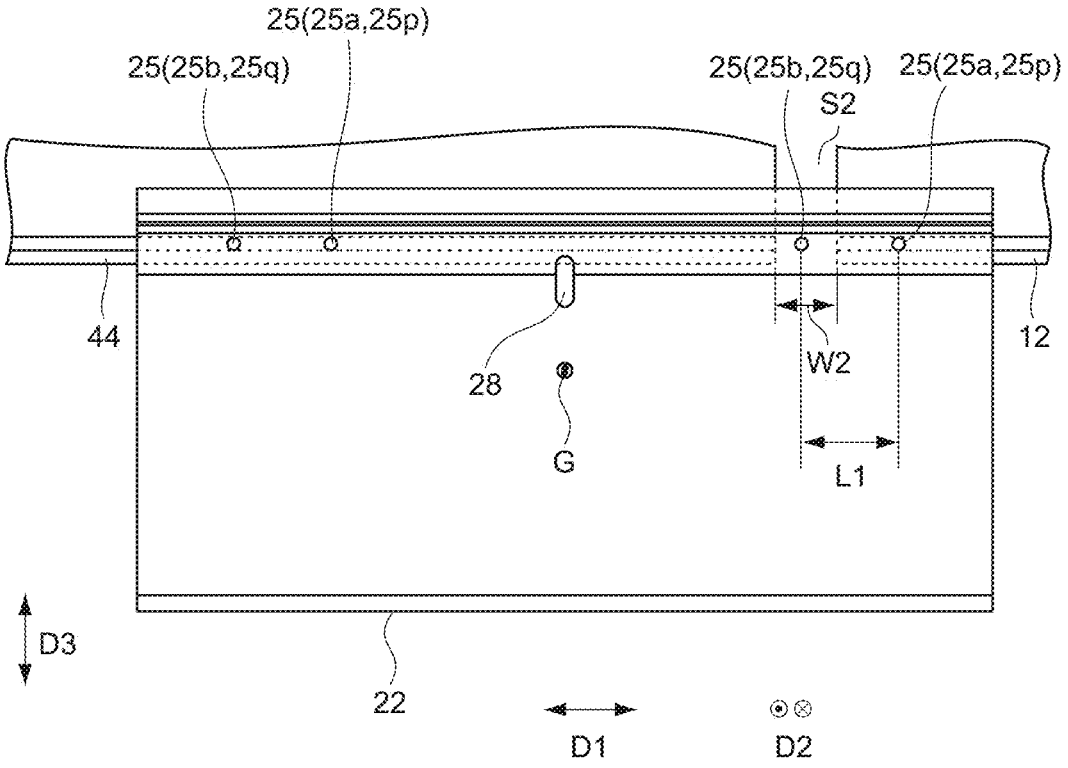
FIGS. 8A and 8B show states in which an inner pin (inner guided portion) is positioned in a clearance during transportation of the upper die, FIG. 8A being a front elevation view, and FIG. 8B being a plan view.
Figure 8B:
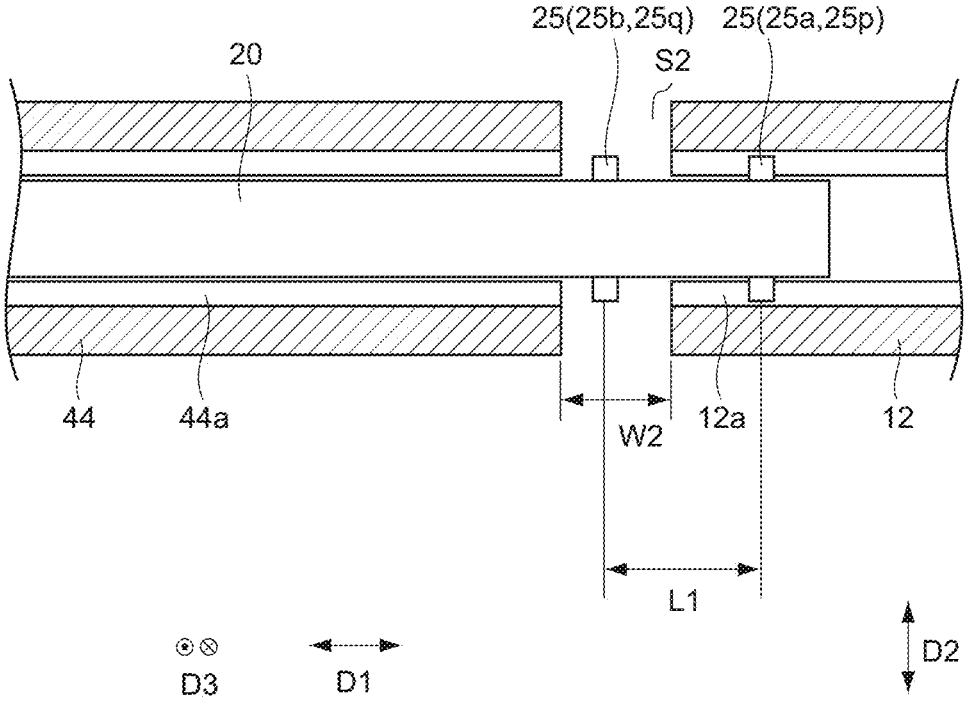

FIGS. 8A and 8B show states in which the inner pin 25*q* is positioned in the clearance S2 during transportation of the upper die 20, FIG. 8A being a front elevation view, and FIG. 8B being a plan view. As the upper die 20 moves forward in the traveling direction from the state shown in FIG. 7, the inner pin 25*q* is positioned in the clearance S2 as shown in FIGS. 8A and 8B. At this time, the outer pin 25*p* is already supported by the groove 12*a* of the upper die guide rail 12. Therefore, even if the inner pin 25*q* is positioned in the clearance S2, the outer pin 25*p* remains in the state of being supported by the groove 12*a* of the upper die guide rail 12. As a result, the inner pin 25*q* is prevented from falling into the clearance S2, and the attitude of the upper die 20 is stabilized. It is thus possible to prevent the inner pin 25*q* from colliding with the end portion of the groove 12*a*.

In this way, even when the upper die 20 is transported from the connection rail 44 to the upper die guide rail 12, it is possible to prevent abnormal noise from occurring during transportation and prevent damage to the upper die 20 and the upper die guide rail 12. Although not shown in the drawings, if transportation of the upper die 20 toward the upper die guide rail 12 is performed from the current state, the inner pin 25*q* on the rear side is positioned in the clearance S2. At this time, since the outer pin 25*p* on the rear side is supported by the groove 44*a* of the connection rail 44, the inner pin 25*q* is prevented from falling into the clearance S2. When the outer pin 25*p* on the rear side is positioned in the clearance S2, the inner pin 25*q* is supported by the groove 12*a* of the upper die guide rail 12, and as a result, the outer pin 25*p* is prevented from falling into the clearance S2.

When the upper die 20 is transported from the upper die guide rail 12 to the connection rail 44, first, the outer pin 25*p* on the leading side in the traveling direction is positioned in the clearance S2. At this time, the inner pin 25*q* remains in the state of being supported by the groove 12*a* of the upper die guide rail 12. As a result, the outer pin 25*p* is prevented from falling into the clearance S2, and it is thus possible to prevent the outer pin 25*p* from colliding with the end portion of the groove 44*a*. When the inner pin 25*q* is positioned in the clearance S2, the outer pin 25*p* is supported by the groove 44*a* of the connection rail 44. As a result, the inner pin 25*q* is prevented from falling into the clearance S2, and it is thus possible to prevent the inner pin 25*q* from colliding with the end portion of the groove 44*a*. If transportation of the upper die 20 toward the connection rail 44 is performed from the current state, the inner pin 25*q* on the rear side is positioned in the clearance S2. At this time, since the outer pin 25*p* on the rear side is supported by the groove 12*a* of the upper die guide rail 12, the inner pin 25*q* is prevented from falling into the clearance S2. When the outer pin 25*p* on the rear side is positioned in the clearance S2, the inner pin 25*q* is supported by the groove 44*a* of the connection rail 44, and as a result, the outer pin 25*p* is prevented from falling into the clearance S2.

In FIGS. 7A and 7B and FIGS. 8A and 8B, the case where the upper die 20 passes through the clearance S2 between the connection rail 44 and the upper die guide rail 12 is described as an example, however, the above description also similarly applies to case of the upper die 20 passing through the clearance S1 between the cassette 43 and the connection rail 44. Even in the case where either one of the outer pin 25*p* and the inner pin 25*q* is positioned in the clearance S1, since the distance L1 is greater than the clearance distance W1, the other of the outer pin 25*p* and the inner pin 25*q* is supported by the groove 43*a* of the cassette 43 or the groove 44*a* of the connection rail 44. As a result, the outer pin 25*p* or the inner pin 25*q* is prevented from colliding with the end portion of the groove 43*a* or the groove 44*a*.

As described above, according to the upper die 20 and the machining system 200 of the present preferred embodiment, since the distance L1 between the outer pin 25*p* (outer guided portion 25*a*) and the inner pin 25*q* (inner guided portion 25*b*) is greater than the clearance distance W1 of the clearance S1 or the clearance distance W2 of the clearance S2, even when the upper die 20 is transported through the cassette 43, the connection rail 44, and the upper die guide rail 12, the outer pin 25*p* or the inner pin 25*q* is prevented from falling into the clearances S1, S2. As a result, the attitude of the upper die 20 can be stabilized, and the outer pin 25*p* or the inner pin 25*q* can be prevented from colliding with the grooves 12*a*, 43*a*, 44*a*, thus preventing occurrence of abnormal noise and damage to the upper die 20, the upper die guide rail 12, and the connection rail 44.

Figure 9:
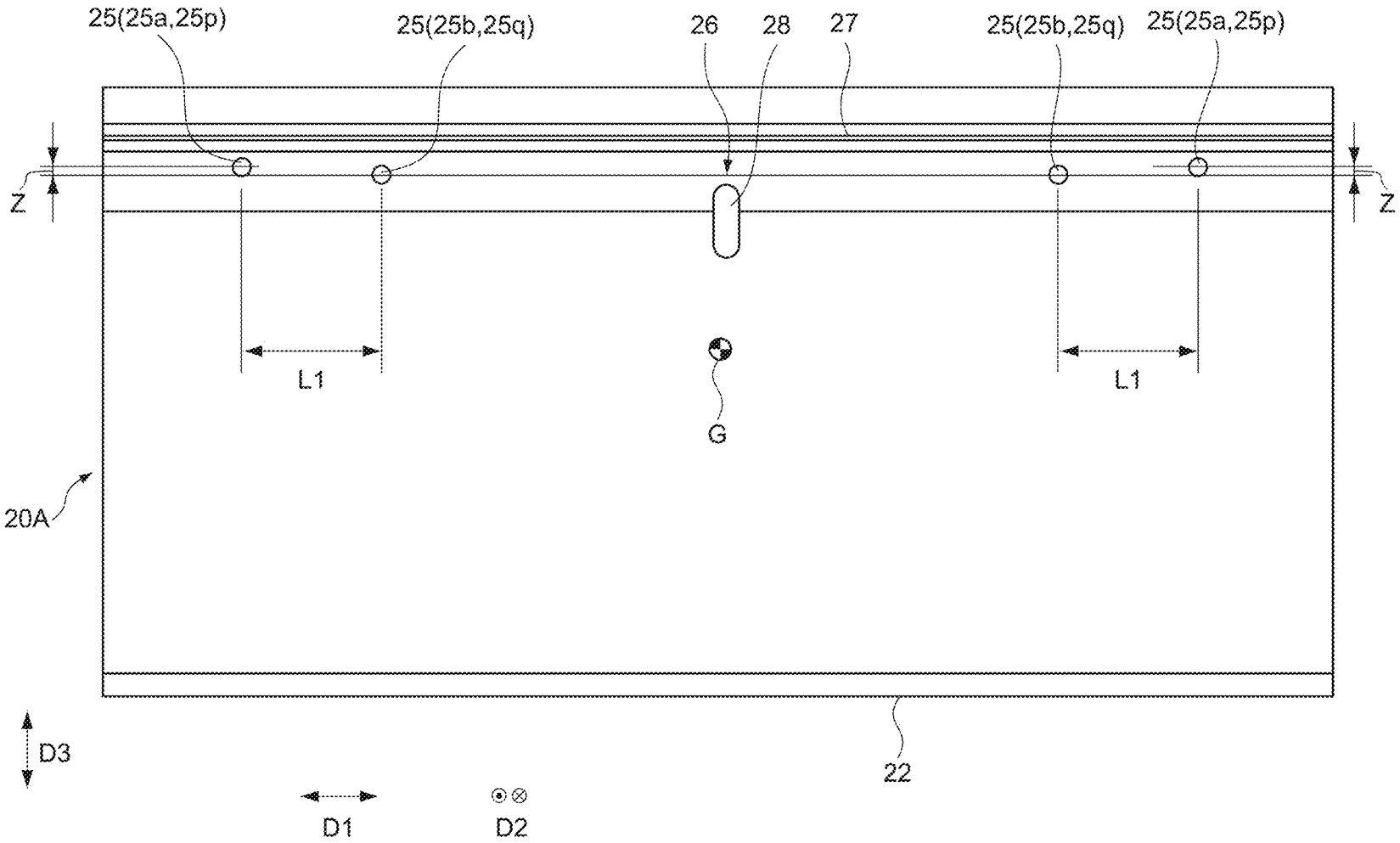
FIG. 9 is a front elevation view showing an example of an upper die according to a first modified example of a preferred embodiment of the present invention.

FIG. 9 to FIG. 15 describe modified examples of the upper die 20. In the following description of each modified example, the same configurations as those of the preferred embodiments described above are assigned with the same reference signs and the descriptions thereof are omitted or simplified. FIG. 9 is a front elevation view showing an example of an upper die 20A according to a first modified example of a preferred embodiment of the present invention. In the upper die 20A shown in FIG. 9, the outer pins 25*p* are arranged above the inner pins 25*q* by a distance Z. The distance Z can be arbitrarily set within a range that allows both the outer pin 25*p* and the inner pin 25*q* can enter the grooves 12*a*, 43*a*, 44*a*. According to the upper die 20A, the outer pins 25*p* are arranged above the inner pins 25*q*, so that the outer pin 25*p* can be further prevented from falling into the grooves 12*a*, 43*a*, 44*a*, and the outer pin 25*p* can be reliably prevented from colliding with the grooves 12*a*, 43*a*, 44*a*.

Figure 10A:
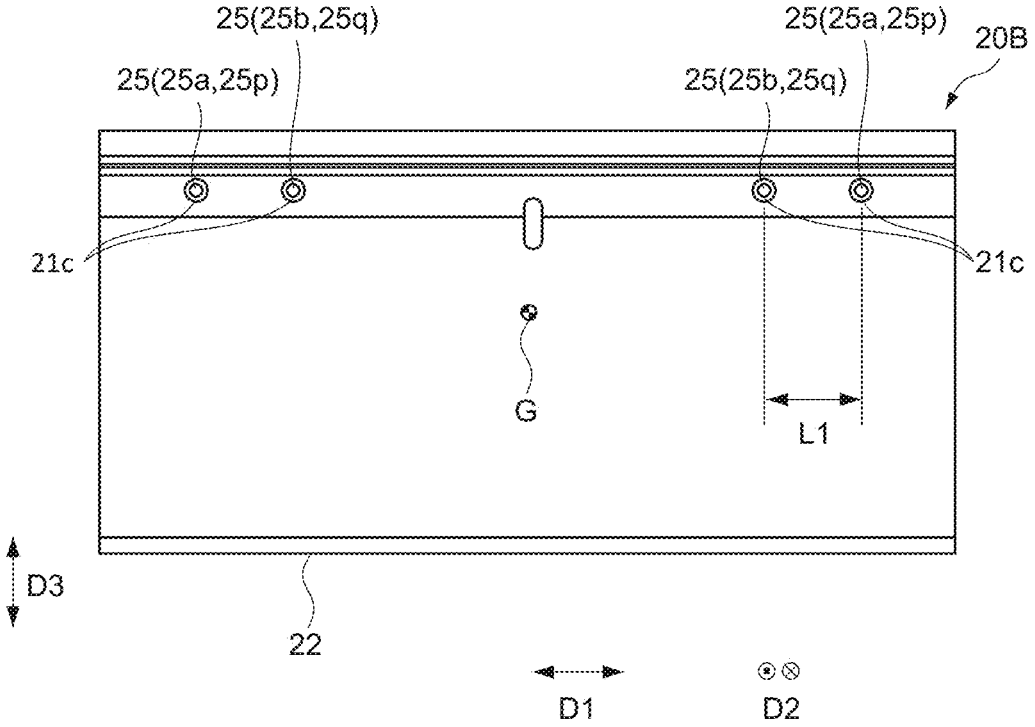
FIGS. 10A to 10B show examples of an upper die according to a second modified example of a preferred embodiment of the present invention, FIG. 10A being a front elevation view, and FIG. 10B being a cross-sectional view seen in the transportation direction.
Figure 10B:
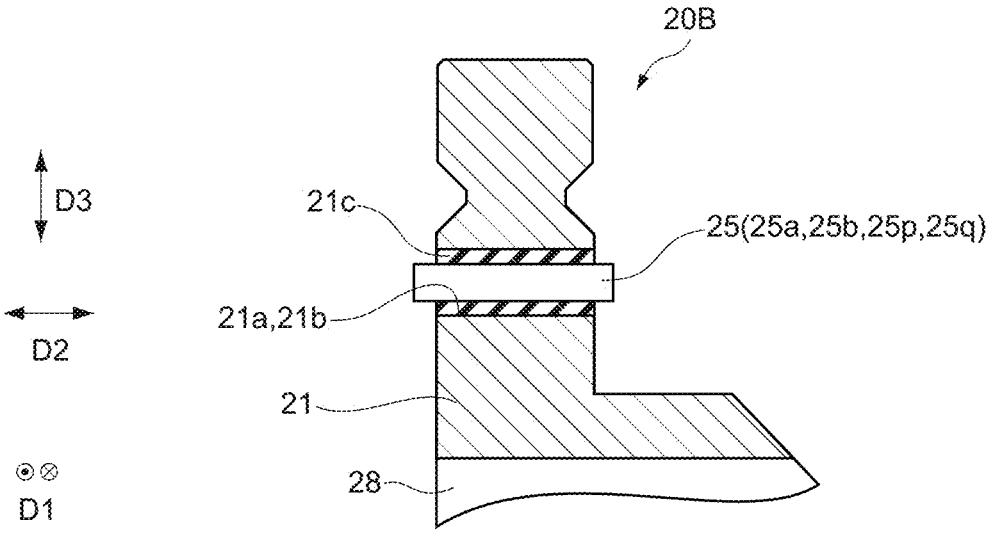

FIGS. 10A and 10B show examples of an upper die 20B according to a second modified example of a preferred embodiment of the present invention, FIG. 10A being a front elevation view, and FIG. 10B being a cross-sectional view seen in the transportation direction. In the upper die 20B shown in FIGS. 10A and 10B, the outer pins 25*p* and the inner pins 25*q* are provided so as to respectively pass through through-holes 21*a*, 21*b* extending in the front-rear direction and protruding from both the front side and the rear side. Moreover, an elastic body 21*c* is arranged both between the outer pin 25*p* and the through hole 21*a* and between the inner pin 25*q* and the through hole 21*b*. For the elastic body 21*c*, a material such as rubber, soft resin, or the like is used, for example. According to this upper die 20B, the elastic body 21*c* can mitigate the influence of the load of the upper die 20B applied to the outer pin 25*p* and the inner pin 25*q* and can also mitigate impact on the outer pin 25*p* and the inner pin 25*q*. It should be noted that the elastic body 21*c* is not limited to being arranged between all the outer pins 25*p* and the inner pins 25*q* and the through holes 21*a*, 21*b*. For example, the elastic body 21*c* may be arranged either between the outer pins 25*p* and the through holes 21*a* or between the inner pins 25*q* and the through holes 21*b*. Also, the elastic body 21*c* may be arranged between some (for example, one) of the plurality of outer pins 25*p* and the through hole 21*a*, or the elastic body 21*c* may be arranged between some (for example, one) of the plurality of inner pins 25*q* and the through hole 21*b*.

Figure 11:
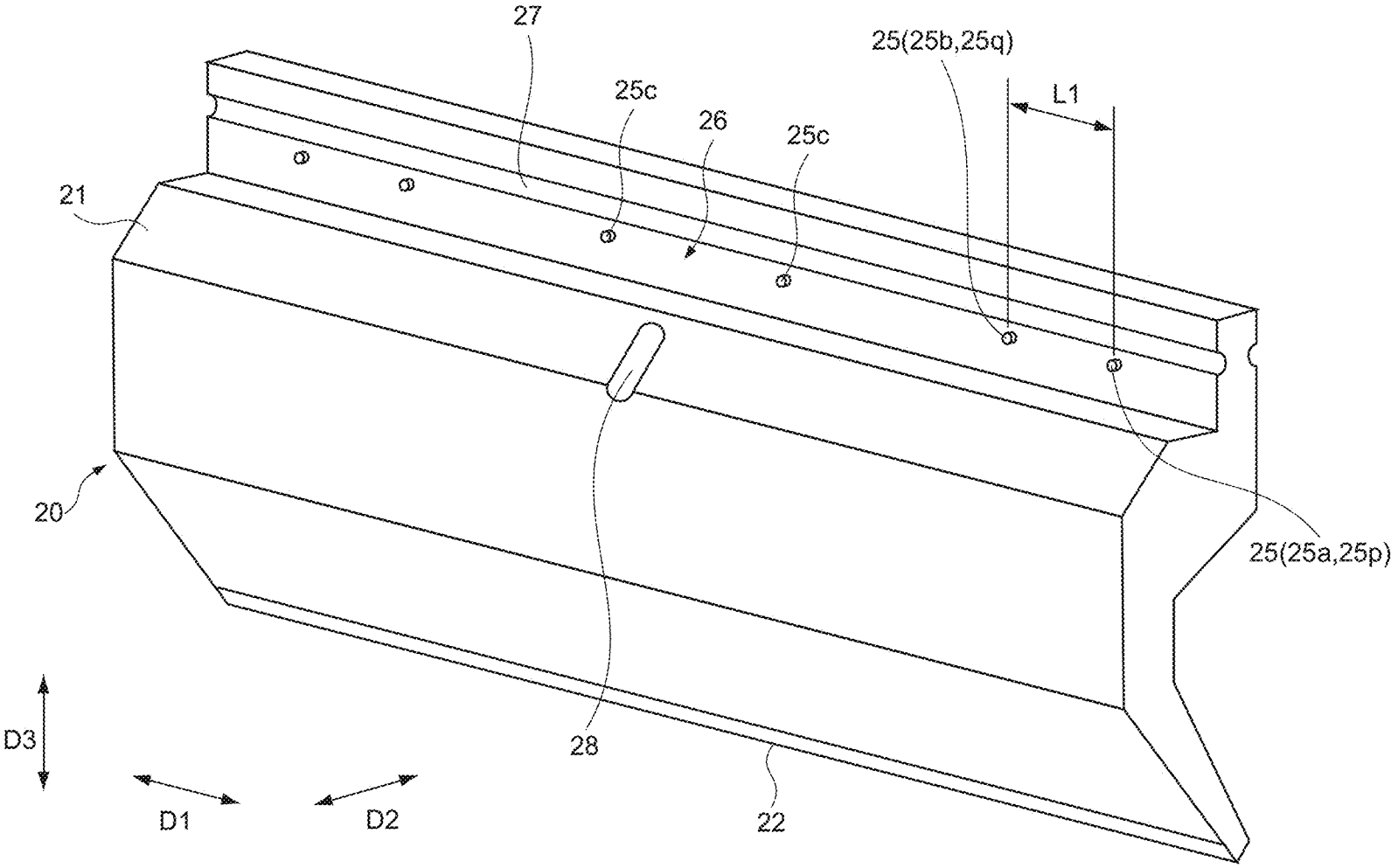
FIG. 11 is a perspective view showing an example of an upper die according to a third modified example of a preferred embodiment of the present invention.

FIG. 11 is a perspective view showing an example of an upper die 20C according to a third modified example of a preferred embodiment of the present invention. In the upper die 20C shown in FIG. 11, auxiliary pins 25*c* that protrude in the front-rear direction and move while being guided by the grooves 12*a*, 43*a*, 44*a* may be provided between the inner pin 25*q* on the left and the inner pin 25*q* on the right. As with the outer pins 25*p* and the inner pins 25*q*, the auxiliary pin 25*c* may be provided as a rod-shaped body passing through the base 21 in the front-rear direction D2 or may be provided as being integrated with the base 21 via cutting or the like. The auxiliary pin 25*c* may be of the same form as those of the outer pin 25*p* and the inner pin 25*q* or may be of a different form. Each auxiliary pin 25*c* is provided at the same height position as those of the outer pins 25*p* and the inner pins 25*q*.

According to this upper die 20C, the load of the upper die 20C can be distributed by the outer pins 25*p*, the inner pins 25*q*, and the auxiliary pin 25*c*, and the burden on the outer pins 25*p* and the inner pins 25*q* can be reduced. In the upper die 20C shown in FIG. 11, the auxiliary pin 25*c* is provided at two locations across the center portion 26 in the transportation direction D1, however, the present invention is not limited to this configuration. For example, one, three or more auxiliary pins 25*c* may be provided.

Figure 12:
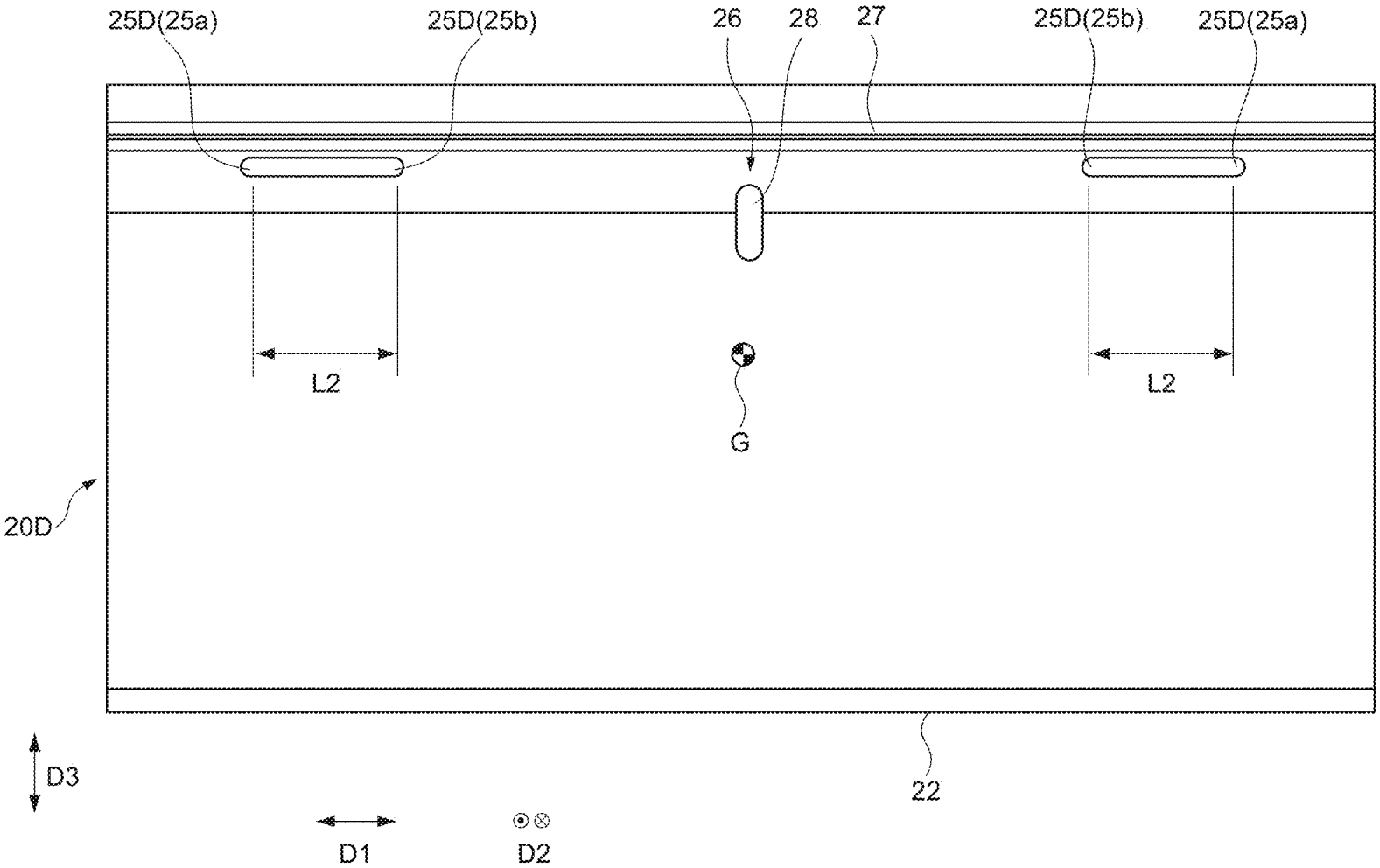
FIG. 12 is a front elevation view showing an example of an upper die according to a fourth modified example of a preferred embodiment of the present invention.

FIG. 12 is a front elevation view showing an example of an upper die 20D according to a fourth modified example of a preferred embodiment of the present invention. In the upper die 20D shown in FIG. 12, each protrusion is a continuous protrusion 25D protruding in a continuous manner in the transportation direction D1 from the outer guided portion 25*a* to the inner guided portion 25*b*. The continuous protrusion 25D protrudes in the front-rear direction D2 from the base 21 and extend in the transportation direction D1. The continuous protrusion 25D may be referred to as plate-shaped protrusion in some case. In this continuous protrusion 25D, the distance L2 between the outer guided portion 25*a* and the inner guided portion 25*b* is greater than the clearance distance W1 of the clearance S1 and the clearance distance W2 of the clearance S2. Both ends of the continuous protrusion 25D in the transportation direction D1 preferably have a semicircular shape.

According to this upper die 20D, since the distance L2 of the continuous protrusion 25D is greater than the clearance distances W1, W2, even when the continuous protrusion 25D is positioned in the clearances S1, S2, it is possible to prevent it from falling into the clearances S1, S2. Since the continuous protrusion 25D is greater in the transportation direction D1 than the outer pin 25*p* and the inner pin 25*q* described above, it is possible to bear the load of the upper die 20D in a wide range.

Figure 13:
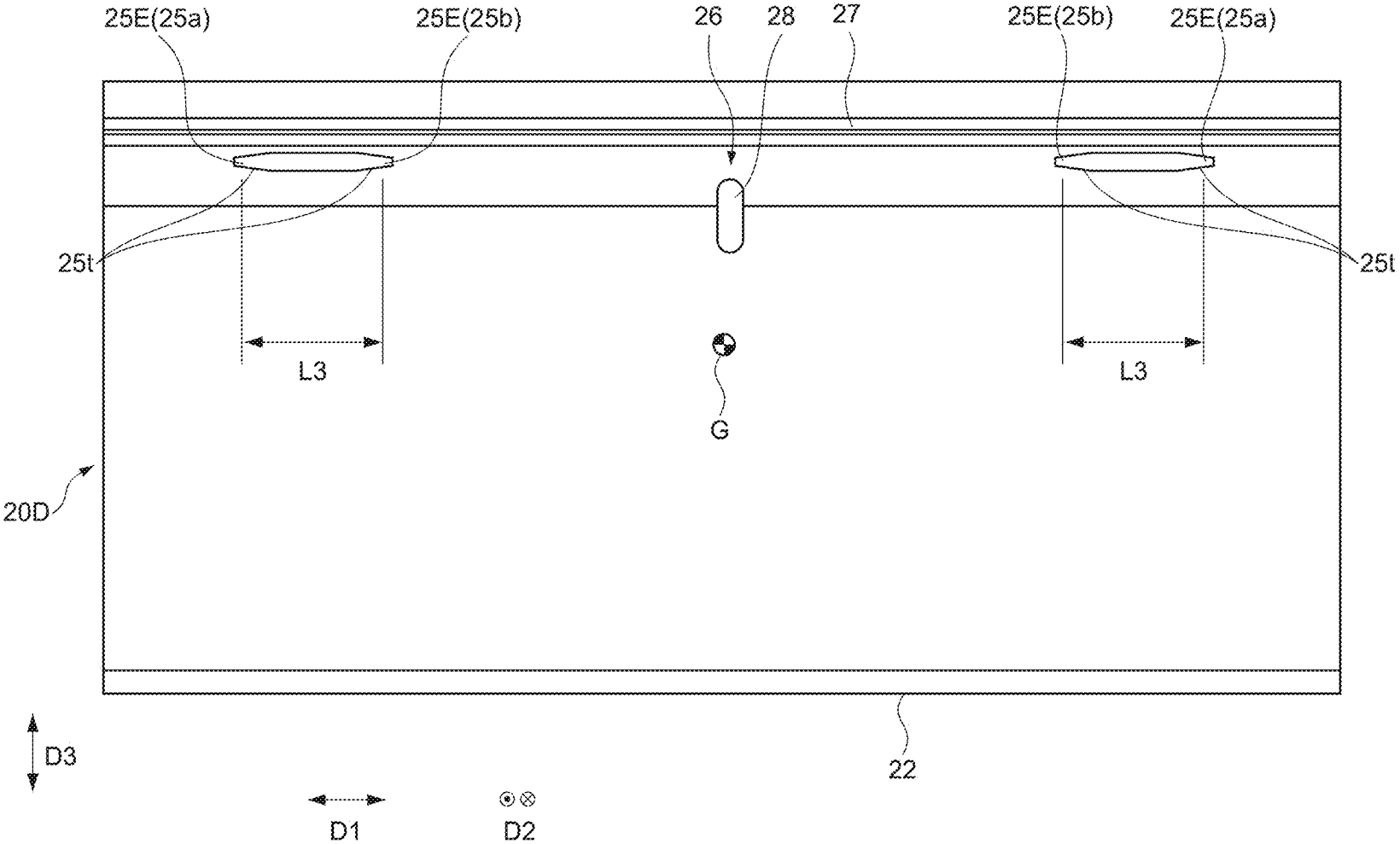
FIG. 13 is a front elevation view showing an example of an upper die according to a fifth modified example of a preferred embodiment of the present invention.

FIG. 13 is a front elevation view showing an example of an upper die 20E according to a fifth modified example of a preferred embodiment of the present invention. In the upper die 20E shown in FIG. 13, each protrusion is a continuous protrusion (plate-shaped protrusion) 25E protruding in a continuous manner in the transportation direction D1 from the outer guided portion 25*a* to the inner guided portion 25*b*. The continuous protrusion 25E protrudes in the front-rear direction D2 from the base 21 and extend in the transportation direction D1. In this continuous protrusion 25E, the distance L3 between the outer guided portion 25*a* and the inner guided portion 25*b* is greater than the clearance distance W1 of the clearance S1 and the clearance distance W2 of the clearance S2. On each lower surface of the outer guided portion 25*a* and the inner guided portion 25*b* there is provided a tapered surface 25*t* that inclines upward. The angle of the tapered surface 25*t* relative to the transportation direction D1 can be set arbitrarily.

According to this upper die 20E, since a distance L3 of the continuous protrusion 25E is greater than the clearance distances W1, W2, even when the continuous protrusion 25E is positioned in the clearances S1, S2, it is possible to prevent it from falling into the clearances S1, S2. Since the continuous protrusion 25E is greater in the transportation direction D1 than the outer pin 25*p* and the inner pin 25*q* described above, it is possible to bear the load of the upper die 20 in a wide range. Since the tapered surface 25*t* is provided on each lower surface of the outer guided portion 25*a* and the inner guided portion 25*b*, it is possible to reliably prevent the outer guided portion 25*a* or the inner guided portion 25*b*, which are end portions of the continuous protrusion 25E, from colliding with the grooves 12*a*, 43*a*, 44*a*. The configuration is not limited to providing the tapered surface 25*t* on both the outer guided portion 25*a* and the inner guided portion 25*b*, and the tapered surface 25*t* may be provided only on either the outer guided portion 25*a* or the inner guided portion 25*b*.

Figure 14:
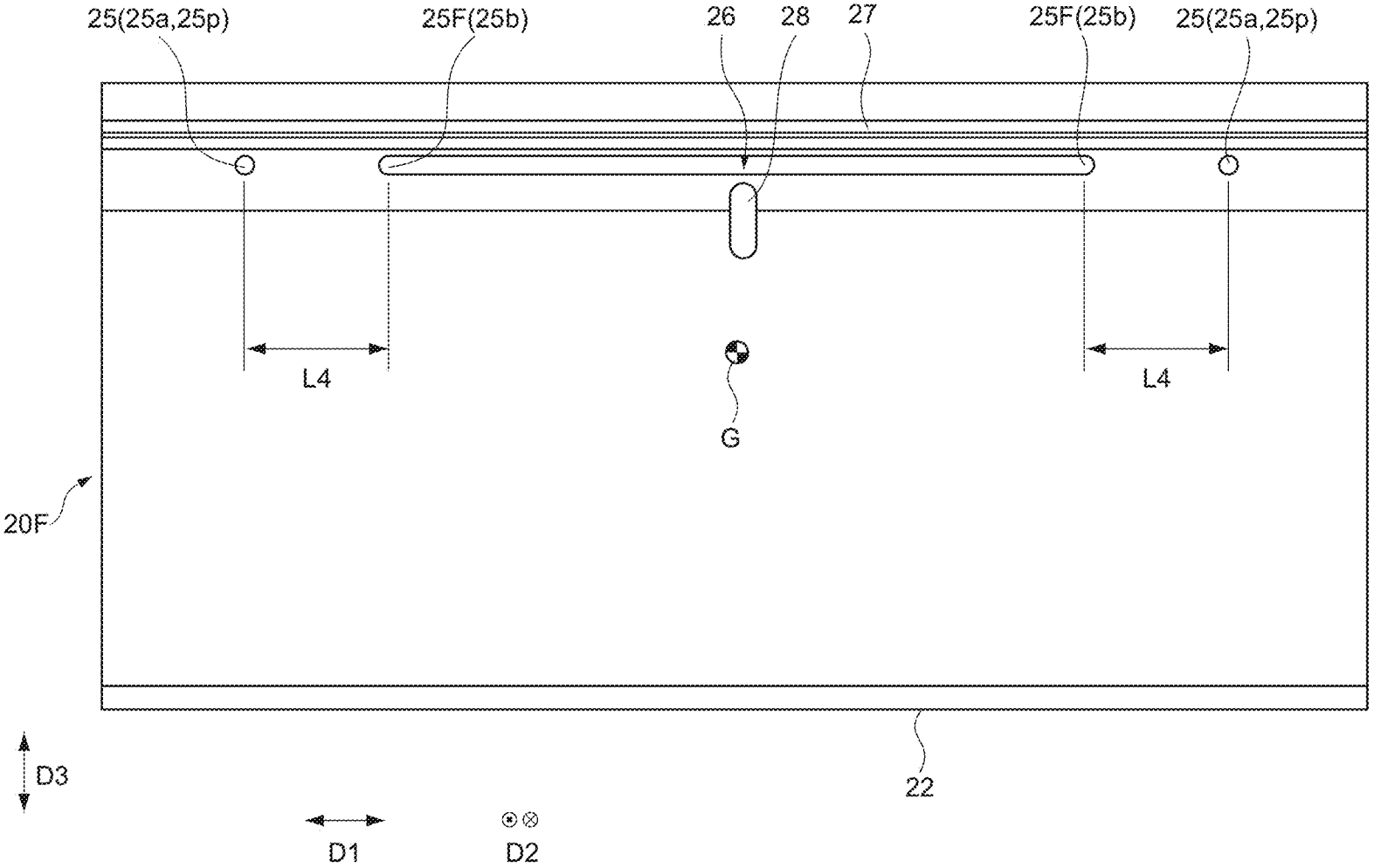
FIG. 14 is a front elevation view showing an example of an upper die according to a sixth modified example of a preferred embodiment of the present invention.

FIG. 14 is a front elevation view showing an example of an upper die 20F according to a sixth modified example of a preferred embodiment of the present invention. In the upper die 20F shown in FIG. 14, the protrusions 25 are such that the outer pins 25*p* are provided as outer guided portions 25*a*, however, the left and right inner guided portions 25*b* are provided as a continuous protrusion (plate-shaped protrusion) 25F protruding in a continuous manner in the transportation direction D1. The continuous protrusion 25F protrudes in the front-rear direction D2 from the base 21 and extends in the transportation direction D1. A distance L4 between the outer pin 25*p* and the inner guided portion 25*b*, which is a portion of the continuous protrusion 25F, is greater than the clearance distance W1 of the clearance S1 and the clearance distance W2 of the clearance S2. Both ends of the continuous protrusion 25E in the transportation direction D1 preferably have a semicircular shape.

According to this upper die 20F, since the distance L4 between the outer pin 25*p* and the inner guided portion 25*b* of the continuous protrusion 25F is greater than the clearance distances W1, W2, even when the outer pin 25*p* or the continuous protrusion 25F is positioned in the clearances S1, S2, it is possible to prevent it from falling into the clearances S1, S2. Since the continuous protrusion 25F is elongated in the transportation direction D1, it is possible to bear the load of the upper die 20 in a wide range.

Figure 15:
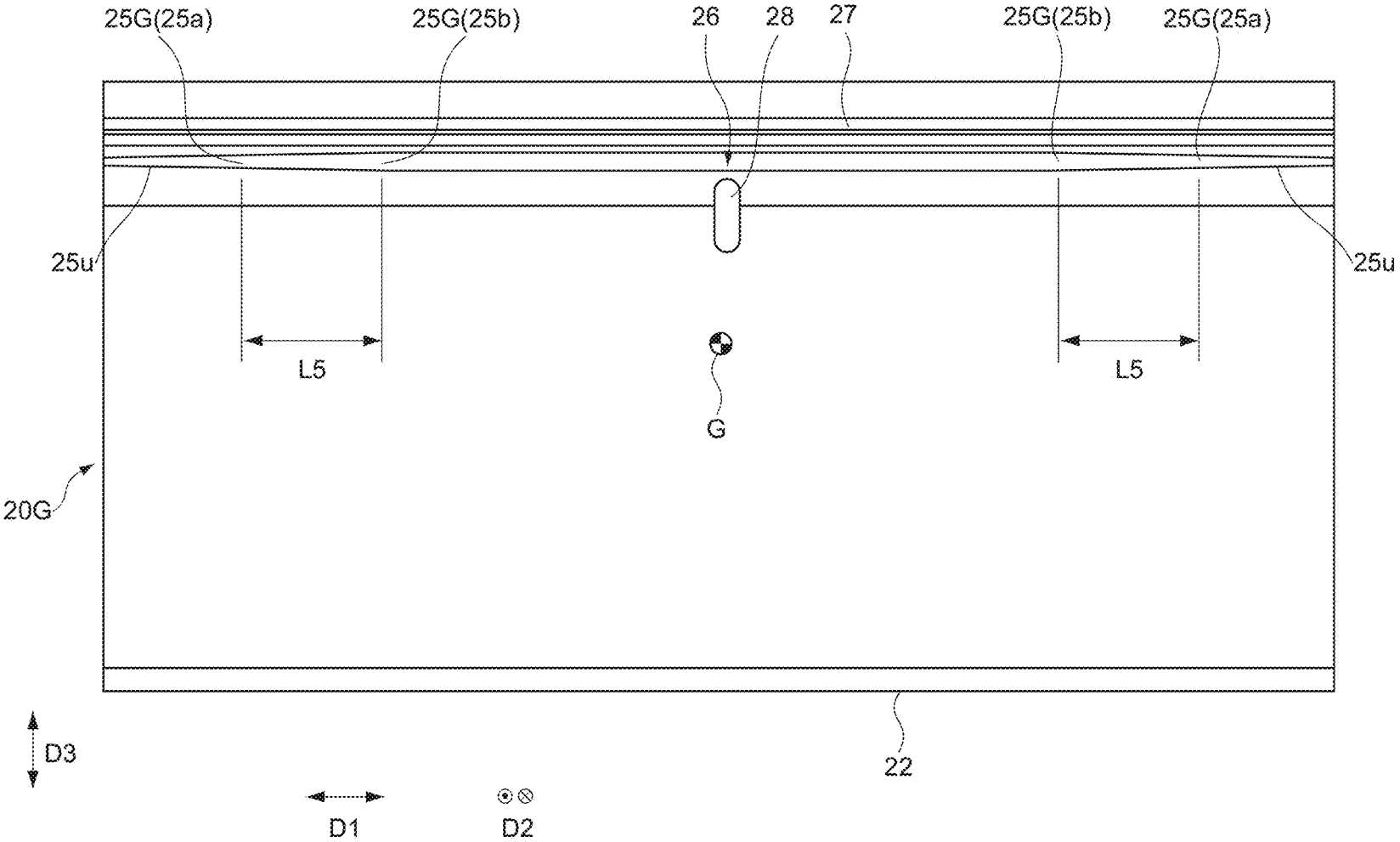
FIG. 15 is a front elevation view showing an example of an upper die according to a seventh modified example of a preferred embodiment of the present invention.

FIG. 15 is a front elevation view showing an example of an upper die 20G according to a seventh modified example of a preferred embodiment of the present invention. In the upper die 20G shown in FIG. 15, the protrusion is such that the outer guided portions 25*a* and the inner guided portions 25*b* on left and right are a continuous protrusion (plate-shaped protrusion) 25G that protrudes in a continuous manner in the transportation direction D1. The continuous protrusion 25G protrudes in the front-rear direction D2 from the base 21 and extends in the transportation direction D1. A distance L5 between the outer guided portion 25*a*, which is a portion of the continuous protrusion 25G, and the inner guided portion 25*b*, which is a portion of the continuous protrusion 25G, is greater than the clearance distance W1 of the clearance S1 and the clearance distance W2 of the clearance S2. On the lower surface of each outer guided portion 25*a* there is provided a tapered surface 25*u* that inclines upward. The angle of the tapered surface 25*u* relative to the transportation direction D1 can be set arbitrarily.

According to this upper die 20G, since the distance L5 between the outer guided portion 25*a* and the inner guided portion 25*b* of the continuous protrusion 25G (that is, the length of the continuous protrusion 25G in the transportation direction D1) is greater than the clearance distances W1, W2, even when the continuous protrusion 25G is positioned in the clearances S1, S2, it is possible to prevent it from falling into the clearances S1, S2. Since the continuous protrusion 25G is elongated in the transportation direction D1, it is possible to bear the load of the upper die 20G in an even wider range. Since the tapered surface 25*u* is provided on the lower surface of each outer guided portion 25*a*, it is possible to reliably prevent the outer guided portion 25*a*, which is an end portion side of the continuous protrusion 25G, from colliding with the grooves 12*a*, 43*a*, 44*a*.

Figure 16:
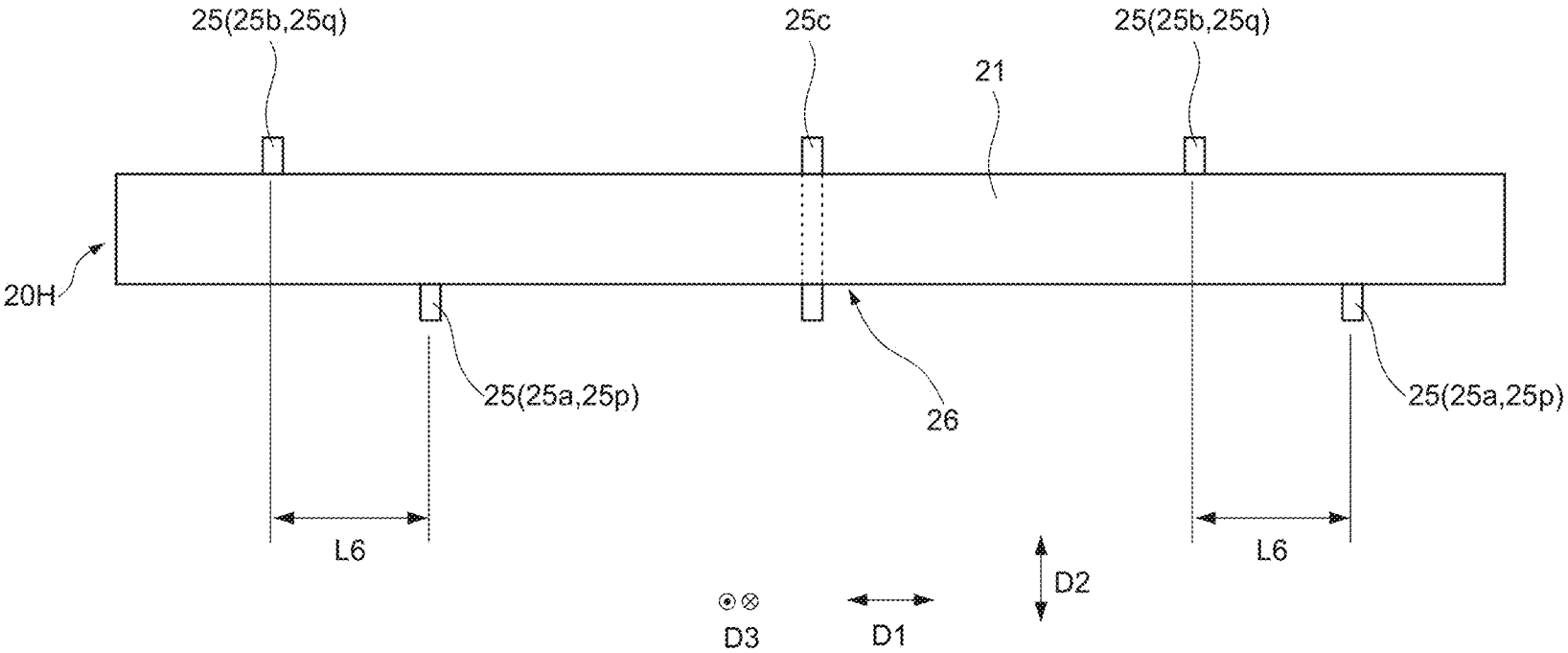
FIG. 16 is a plan view showing an example of an upper die according to an eighth modified example of a preferred embodiment of the present invention.

FIG. 16 is a plan view showing an example of an upper die 20H according to an eighth modified example of a preferred embodiment of the present invention. In the upper die 20H shown in FIG. 16, the outer pin 25*p* and the inner pin 25*q* are provided on both the left and right sides in the transportation direction D1 of the center portion 26. The outer pins 25*p* are provided on one side (for example, the front side) of the base 21 in the front-rear direction D2, and the inner pins 25*q* are provided on the other side of the base 21 (for example, the rear side). The outer pin 25*p* and the inner pin 25*q* each protrude from the base 21 in opposite directions in the front-rear direction D2. A distance L6 between the outer pin 25*p* and the inner pin 25*q* is greater than the clearance distance W1 of the clearance S1 and the clearance distance W2 of the clearance S2. The upper die 20H includes an auxiliary pin 25*c* at the center portion 26 in the transportation direction D1.

According to this upper die 20H, since the distance L6 between the outer pin 25*p* and the inner pin 25*q* is greater than the clearance distances W1, W2, even when the outer pin 25*p* or the inner pin 25*q* is positioned in the clearances S1, S2, it is possible to prevent it from falling into the clearances S1, S2. Since the number of protrusions 25 is small, the configuration of the upper die 20H can be simplified. By providing the auxiliary pin 25*c*, the load of the upper die 20H can be distributed by the outer pins 25*p*, the inner pins 25*q*, and the auxiliary pin 25*c*, and the burden on the outer pins 25*p* and the inner pins 25*q* can be reduced. Two or more auxiliary pin 25*c* may be provided, or the auxiliary pin 25*c* need not be provided.

Figure 17:
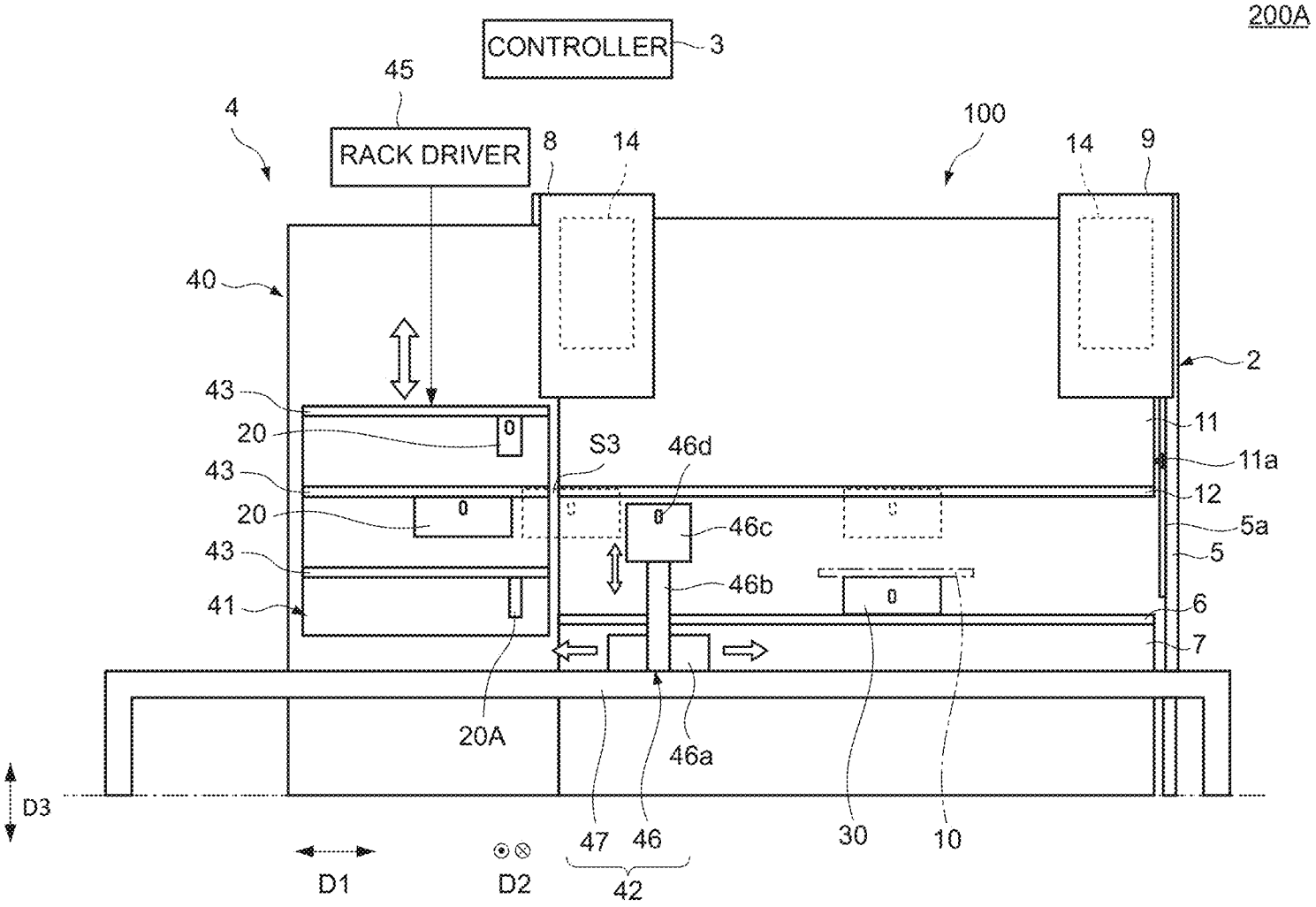
FIG. 17 is a front elevation view showing an example of a machining system according to a second preferred embodiment of the present invention.

FIG. 17 is a front elevation view showing an example of a machining system 200A according to a second preferred embodiment. In the following description, the same configurations as those in the first preferred embodiment described above are assigned with the same reference signs and the descriptions thereof are omitted or simplified. In the machining system 200A shown in FIG. 17, the connection rail 44 (see FIG. 1 and so forth) is not provided, and the stocker 40 of the die switching device 4 is installed adjacent to the press machine 100. In such a case, the upper die guide rail 12 of the ram 11 is connected to the cassette 43 of the rack 41. That is to say, the cassette 43 defines and functions as a connection rail in the upper die guide rail 12.

In the machining system 200A, the upper die 20 moves through the cassette 43 and the upper die guide rail 12. In such a case, the upper die 20 travels over a clearance S3 between the cassette 43 and the upper die guide rail 12. In the upper dies 20A, 20B, 20C, 20D, 20E, 20F, 20G, 20H, the distances L1, L2, L3, L4, L5, L6 are all greater than the clearance distance of the clearance S3. Therefore, when transporting the upper die 20 between the upper die guide rail 12 and the cassette 43, even when either one of the outer guided portion 25*a* or the inner guided portion 25*b* is positioned in the clearance S3 between the upper die guide rail 12 and the cassette 43, the other remains in the state of being supported by the groove 12*a* or the groove 43*a* of the upper die guide rail 12 or the cassette 43. As a result, the outer guided portion 25*a* or the inner guided portion 25*b* is prevented from falling into the clearance S3.

As described above, according to the machining system 200A, as with the first preferred embodiment, when transporting the upper die 20 between the upper die guide rail 12 and the cassette 43, the attitude of the upper die 20 can be stabilized, and the outer guided portion 25*a* or the inner guided portion 25*b* can be prevented from colliding with the groove 12*a*. As a result, it is possible to prevent abnormal noise from occurring and prevent damage to the upper die 20, the upper die guide rail 12, and the cassette 43.

The preferred embodiments and the modified examples of the present invention have been described above. However, the technical scope of the present invention is not limited to the description of the above preferred embodiments or the modified examples. One or more of the configurations described in the above preferred embodiments or the modified examples may be combined where appropriate. The contents of Japanese Patent Application No. 2020-156197 and all documents cited in the detailed description of the present invention are incorporated herein by reference to the extent permitted by law. For example, in the above preferred embodiments, the case of transporting the upper die 20 has been described as an example, however, the present invention is not limited to this example, and similar configurations can also be applied to a case of transporting the lower die 30.

In the above preferred embodiments, the transporter 46 transports the upper die 20 or the like in the state in which the locking portion 46*d* is inserted in the locked portion 28 of the upper die 20 or the like. However, the present invention is not limited to this example. For example, transportation may be performed by sucking or gripping a part of the upper die 20 or the like. Furthermore, in the preferred embodiments described above, even in the case where an upward forces acts on either one of the outer guided portion 25*a* (for example, outer pin 25*p*) and the inner guided portion 25*b* (for example, inner pin 25*q*) in the clearances S1, S2, the other of the outer guided portion 25*a* and the inner guided portion 25*b* comes in contact with the upper surfaces side of the grooves 12*a*, 43*a*, 44*a*, and thus, the outer guided portion 25*a* or the inner guided portion 25*b* is prevented from ascending in the clearances S1, S2. As a result, the outer guided portion 25*a* or the inner guided portion 25*b* is prevented from colliding with the ends of the grooves 12*a*, 43*a*, 44*a*. Moreover, an upward force may be actively applied to the outer guided portion 25*a* or the inner guided portion 25*b* so that the outer guided portion 25*a* or the inner guided portion 25*b* comes in contact with the ends of the grooves 12*a*, 43*a*, 44*a*, or an upward force may be applied to the outer guided portion 25*a* or the inner guided portion 25*b* (in a state having a short distance from the upper surface or the lower surface of the grooves 12*a*, 43*a*, 44*a*) so that the outer guided portion 25*a* or the inner guided portion 25*b* does not come into contact with the ends of the grooves 12*a*, 43*a*, 44*a*. For example, in the case where the sectional shapes of the locked portion 28 of the upper die 20 and the locking portion 46*d* of the transporter 46 are oval or elliptical, a configuration may be used in which an upward force is applied to the outer guided portion 25*a* or the inner guided portion 25*b* by rotating the locking portion 46*d* around an axis parallel to the front-rear direction D2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A system comprising:

an upper die;

a press machine to perform press machining on a workpiece via the upper die and a lower die, the press machine including a ram and a die quide rail on a lower portion of the ram; and a connection rail connected to the die guide rail on the lower portion of the ram in the press machine; wherein the upper die that is movable through the die guide rail on a lower portion of a ram in a press machine and the connection rail connected to the die guide rail;

the upper die includes a center portion, and on right and left sides of the center portion as viewed in a front-rear direction orthogonal to a transportation direction of the upper die and an up-down direction, protrusions that protrude in the front-rear direction and are movable while being guided by grooves included in the die guide rail and the connection rail; wherein each of the protrusions includes an outer guided portion on an outer side in the transportation direction relative to the center portion and an inner guided portion on an inner side closer to the center portion than the outer guided portion; and a distance in the transportation direction between the outer guided portion and the inner guided portion is greater than a clearance distance between the die guide rail and the connection rail.

2. The system according to claim 1, wherein the protrusions include an outer pin defining the outer guided portion and an inner pin defining the inner guided portion.

3. The system according to claim 2, wherein the outer pin is above the inner pin.

4. The system according to claim 2, wherein the outer pin and the inner pin are positioned to pass through through-holes in the front-rear direction and protrude from both a front side and a rear side; and an elastic body is provided at least either between the outer pin and the through hole or between the inner pin and the through hole.

5. The system according to claim 2, wherein an auxiliary pin that protrudes in the front-rear direction and is movable while being guided by the groove is provided between the inner pin on the left and the inner pin on the right.

6. The system according to claim 1, wherein each of the protrusions is a continuous protrusion positioned to protrude in a continuous manner from the outer guided portion to the inner guided portion.

7. The system according to claim 6, wherein the continuous protrusion includes a tapered surface that slopes upward on a lower surface of at least either the outer guided portion or the inner guided portion.

8. The system according to claim 6, wherein the inner guided portion on the left and the inner guided portion on the right protrude in a continuous manner.

9. The system according to claim 1, wherein the upper die includes a locked portion extending in the front-rear direction; and the system further comprises a transporter that includes a locking portion extendible and retractable in the front-rear direction to lock the locked portion in the transportation direction, and to transport the upper die as the locking portion moves in the transportation direction while locking the locked portion.

* * * * *